US006501924B2

(12) United States Patent
Nagashima

(10) Patent No.: US 6,501,924 B2
(45) Date of Patent: Dec. 31, 2002

(54) METHOD OF MANUFACTURING DEVELOPER CONTAINER, METHOD OF MANUFACTURING PROCESS CARTRIDGE, DEVELOPER CONTAINER AND PROCESS CARTRIDGE

(75) Inventor: Toshiaki Nagashima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/906,681

(22) Filed: Jul. 18, 2001

(65) Prior Publication Data

US 2002/0021915 A1 Feb. 21, 2002

(30) Foreign Application Priority Data

Jul. 19, 2000 (JP) ..... 2000/218437
Jul. 17, 2001 (JP) ..... 2001/216310

(51) Int. Cl.[7] ..... G03G 15/08

(52) U.S. Cl. ..... 399/106; 156/69; 156/583.2; 399/111

(58) Field of Search ..... 399/103, 106, 399/109, 111; 156/69, 583.2

(56) References Cited

U.S. PATENT DOCUMENTS 4,065,335 A * 12/1977 Pollack ..... 156/69
4,931,838 A 6/1990 Ban et al. ..... 355/260
5,491,542 A 2/1996 Nagashima ..... 355/260
5,531,846 A * 7/1996 Miraglia et al. ..... 399/109
5,752,131 A * 5/1998 Fujiwara et al. ..... 399/106
5,778,282 A 7/1998 Nagashima ..... 399/106
6,097,907 A * 8/2000 Fujiwara ..... 399/103
6,118,957 A * 9/2000 Fujiwara et al. ..... 399/103
6,118,958 A 9/2000 Nagashima ..... 399/105
6,178,302 B1 1/2001 Nagashima ..... 399/106
6,188,421 B1 * 2/2001 Hayashi et al. ..... 399/106
6,219,506 B1 4/2001 Morinaga et al. ..... 399/109

FOREIGN PATENT DOCUMENTS

JP 59-13262 1/1984
JP 63-60164 U * 4/1988
JP 5-6091 1/1993
JP 8-160727 6/1996

* cited by examiner

*Primary Examiner*—Joan Pendegrass
(74) *Attorney, Agent, or Firm*—Fitzpatrick, Cella, Harper & Scinto

(57) ABSTRACT

A method of manufacturing a developer container having an opening which is sealed with a sealing member includes the steps of forming a tear portion in the sealing member which is torn up when unsealing said opening, sandwiching the sealing member between an electrode and the developer container to cover the opening with the sealing member, and welding the sealing member onto the developer container by supplying an electric current to the electrode.

116 Claims, 14 Drawing Sheets

METHOD OF MANUFACTURING DEVELOPER CONTAINER, METHOD OF MANUFACTURING PROCESS CARTRIDGE, DEVELOPER CONTAINER AND PROCESS CARTRIDGE

BACKGROUND OF THE INVENTION

1. Field of the Invention

The present invention relates to a developer container used in an image forming apparatus such as a copying machine, a printer or a facsimile machine, a method of manufacturing a process cartridge, a developer container and a process cartridge.

2. Description of the Related Background Art

Conventionally, in an image forming apparatus (developing device) such as an electrostatic copying machine or a printer, powder toner is used in conducting image formation (development). A developer container that contains toner therein for supplying the toner when the toner is consumed in a developing device is made up of a cylindrical or rectangular parallelepiped container main body which is made of synthetic resin, and a sealing member that seals a toner discharge opening for discharging the toner from the container main body to the image forming apparatus (developing device) to supply the toner to the image forming apparatus.

The sealing member is so disposed as to prevent the toner from being leaked from the toner discharge opening even if some vibrations occur or the developer container is accidentally caused to drop down during a process of conveying the developer container to a store or a user from a manufacturing factory (in the distribution process). Therefore, the sealing member is appropriately welded to the container main body so that the toner does not leak from the toner discharge opening.

Also, in an electrophotographic image forming apparatus using an electrophotographic image forming process, there is applied a process-cartridge system in which an electrophotographic photosensitive member and a process means effected on the electrophotographic photosensitive member are integrated into a cartridge, and cartridge is detachably mountable on an electrophotographic image forming apparatus main body.

According to the process-cartridge system, since the maintenance of the image forming apparatus can be conducted by a user per se not relying on a service person, the operationality can be remarkably improved. For that reason, the above process-cartridge system is widely employed in the electrophotographic image forming apparatus.

The process cartridge thus structured includes a developing chamber in which a developing roller is disposed as a developing means, and a containing chamber that contains the developer therein, and a toner discharge (supply) opening, which is disposed in the containing chamber and communicates with the developing chamber, is sealed with the sealing member during the manufacture of the process cartridge. Then, the user removes the sealing member from the containing chamber before starting the use of the process cartridge, to thereby supply the toner to the developing chamber from the containing chamber. This structure prevents the toner from being leaked from the containing chamber before the process cartridge is used.

The sealing members are of an easy peeling type in which the toner discharge opening is sealed with one sheet and a welding portion of the film is peeled from the container main body to unseal the opening, and of a tearing type in which a pat of the film is torn up so that the welding portion of the film remains in the container main body, to thereby unseal the opening.

As the type in which the film is torn up, there have been proposed a tear tape system in which a cover film and a tear tape are integrated together, and at the time of starting to use the process cartridge, the tear tape is pulled so that the cover film is torn up by the tear tape to unseal the toner discharge opening, and a system in which one tearing sealing member is employed. Those methods are frequently employed these days because they are advantageous in that the unsealing strength can be lessened and the opening width can be controlled. A method using the one tear sealing member has been proposed in Japanese Patent Application Laid-Open No. 59-13262, Japanese Utility Model Application Laid-Open No. 63-60164, and the like.

Also, as a method of fixing the sealing member to the developer container main body, there are generally provided a melting method using a heat seal, an impulse seal, a high-frequency welding, an ultrasonic welding and so on, and a bonding method using an adhesive double coated tape, a bonding tape and so on. In particular, one means employing a fixing method using the impulse seal is disclosed in Japanese Patent Application Laid-Open No. 5-6091, Japanese Patent Application Laid-Open No. 8-160727 and the like.

However, since the above systems of tearing up the film are so structured as to tear up the sealing member due to a user's force, it is preferable to structure the system so that the sealing member is torn up by a force as small as possible. However, in the conventional system of tearing the film, there is a possibility that the sealing member is unintentionally torn up to unseal the toner discharge opening during the above-mentioned circulation.

SUMMARY OF THE INVENTION

The present invention has been made under the above circumstances, and therefore an object of the present invention is to provide a method of manufacturing a developer container which is capable of excellently sealing the opening of the developer container with a sealing member.

Another object of the present invention is to provide a developer container in which the opening of the developer container is excellently sealed with a sealing member.

Still another object of the present invention is to provide a method of manufacturing a process cartridge which is capable of excellently sealing the opening of the developer container with a sealing member.

Yet still another object of the present invention is to provide a process cartridge in which the opening of the developer container is excellently sealed with a sealing member.

Yet still another object of the present invention is to provide a method of manufacturing a developer container which is capable of excellently removing the sealing member that seals the opening of the developer container.

Yet still another object of the present invention is to provide a developer container which is capable of excellently removing the sealing member that seals the opening of the developer container.

Yet still another object of the present invention is to provide a method of manufacturing a process cartridge which is capable of excellently removing the sealing member that seals the opening of the developer container.

Yet still another object of the present invention is to provide a process cartridge which is capable of excellently removing the sealing member that seals the opening of the developer container.

Other objects of the present invention will become apparent by the following detailed description with reference to the accompanying drawings.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Figure 1:
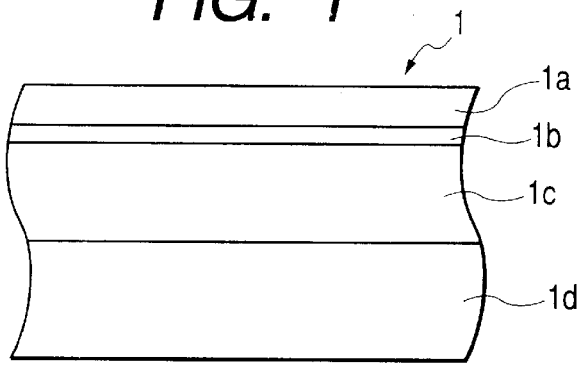
FIG. 1 is a cross-sectional view showing a layer structure of a sealing member used in a toner supplying container in accordance with a first embodiment of the present invention.

Now, a description will be given in more detail of the preferred embodiments of the present invention with reference to the accompanying drawings.

First Embodiment

A description will be given of a sealing member 1 used in a toner supplying container as a developer container that contains the toner serving as the powder therein in accordance with the present invention. The sealing member is so structured as to weld the sealing member to the toner supply container by using the impulse sealing system.

The impulse sealing system is directed to a method of supplying an impulse current (an impulse current that stops immediately after a large current is supplied for a short period of time) to fix the sealing member onto the container main body in a welding manner. In this embodiment, an electrode is structured such that a current circuit is formed so as to surround the toner discharge opening of the container main body. Also, the electrode that serves as a heating member to be used is small in heat capacity, to thereby enable heating by energization for a short period of time. Then, this embodiment is applied with a method in which after the sealing member is pressed against the container main body under a given pressure so that a toner discharge opening has been closed by the electrode (electrode unit), the impulse current is supplied to the electrode to heat the electrode (in this situation, the sealing member is melted by the heat of the electrode). In this method, the pressure state is kept for a moment after the current has been interrupted, and the electrode (electrode unit) is separated after the welding portion of the sealing member and the container main body has been cooled.

The sealing member 1 of this example is structured into four layers, which is comprised of a surface layer, a laser blocking layer, a tear guiding layer and a sealant layer from the upper in the stated order. The surface layer is made of biaxial oriented polyester 12 μm in thickness, the laser blocking layer is made of aluminum foil 7 μm in thickness, the tear guiding layer is made of biaxial oriented polyester 50 μm in thickness, and the sealant layer is made of copolymer consisting of polyethylene, ethylene and vinyl acetate 50 μm in thickness.

FIG. 1 shows a cross-sectional view showing a sealing member 1 which is made up of a surface layer 1*a*, a laser blocking layer 1*b*, a tear guiding layer 1*c* and a sealant layer 1*d* from the upper in the stated order.

The surface layer 1*a* is required to have heat resistance because the sealing member is heat-welded onto a main body of a toner container. Also, it is necessary that the surface layer 1*a* has a film strength sufficient to maintain the sealing performance as the toner seal and has proper tear performance because the toner seal is torn up when the toner discharge opening is unsealed. Taking those performances into consideration, it is desirable to use a biaxial oriented polyester 10 to 20 μm, more preferably 12 to 17 μm in thickness.

The laser blocking layer 1*b* does not absorb the light of the carbon dioxide laser, and it is necessary to surely prevent the surface layer from being damaged by the radiation heat at the time of heat welding during a laser process. In addition, it is necessary that the laser blocking layer 1*b* has proper tear performance because the laser blocking layer 1*b* is torn up when the toner discharge opening is unsealed as in the surface layer. Taking those requirements into consideration, it is desirable to use aluminum foil 5 to 15 μm, and more preferably 7 to 12 μm in thickness.

It is necessary that the tear guiding layer 1*c* surely absorbs the light of the carbon dioxide gas laser and is thermally melted to form a stable tear portion, and it is necessary that the peripheral portion of the tear portion has a sufficient strength as a tear guide. Taking the above into consideration, it is desirable to use biaxial oriented polyester 40 to 70 μm, and more preferably 40 to 60 μm in thickness.

It is necessary that the sealant layer 1*d* ensure sufficient sealing, that is, it is necessary to have a sufficient adhesive strength with respect to the toner container, and it is desirable to use copolymer consisting of ethylene and vinyl acetate 40 to 70 μm, and more preferably 40 to 60 μm in thickness.

The respective layers of the toner seal are structured as described above, but the material and thickness of those layers may be different from those described above if the performances demanded for the respective layers can be satisfied.

Figure 2:
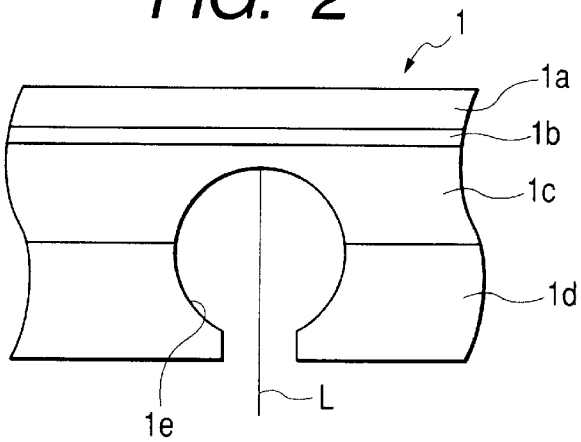
FIG. 2 is a cross-sectional view showing the layer structure of the sealing member used in the toner supplying container in accordance with the first embodiment of the present invention.

Polyester, which is mainly the tear guiding layer 1*c*, is thermally melted by using a carbon dioxide gas laser L being applied to the sealant layer 1*d* side of the sealing member 1, to thereby form a tear portion 1*e*. The cross sectional view of the toner seal on which the tear portion is formed is shown in FIG. 2. As shown in FIG. 2, the tear portion 1*e* is formed on polyester of the tear guiding layer 1*c* which absorbs the light of carbon dioxide laser L to be heated and welded, and on the sealant layer 1*d*, which is welded by the radiation heat, under the aluminum foil layer, which is the laser blocking layer 1*b*.

Figure 3:
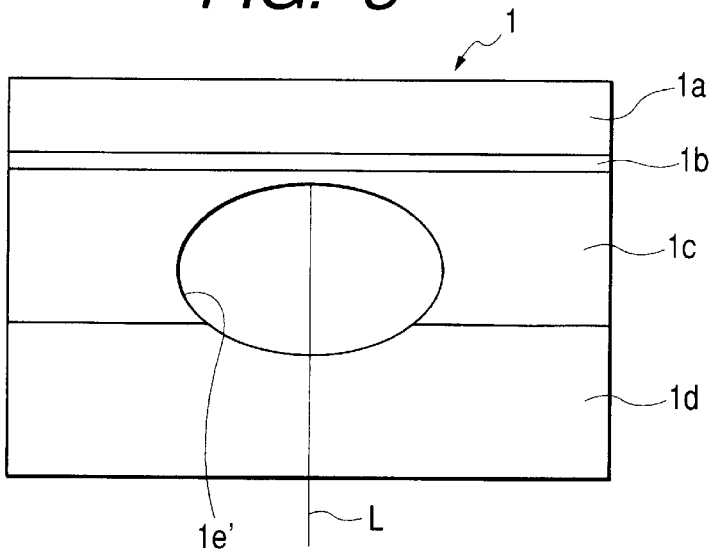
FIG. 3 is a cross-sectional view showing the layer structure of the sealing member used in the toner supplying container in accordance with the first embodiment of the present invention.

The output of the carbon dioxide gas laser L used in this example is set to 8 W. The sealant layer 1*d* per se is not completely melted, depending on the wattage of the laser and the material of the sealant, and the groove of the tear portion 1*e* is not formed as shown in FIG. 2 with the result that gap 1*e*' may be formed in polyester of the tear guiding layer 1*c* and the sealant layer 1*d* as shown in FIG. 3.

A process of assembling the sealing member and the toner container main body according to this example will now be described.

Figure 4:
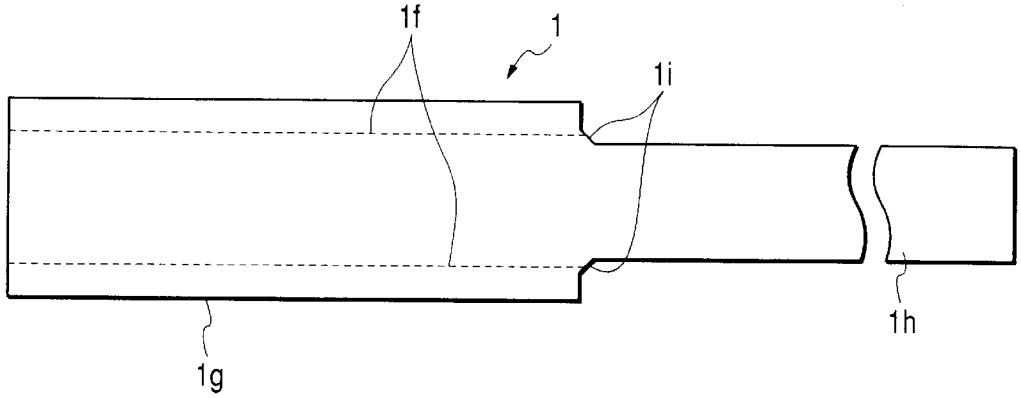
FIG. 4 is a plan view showing the layer structure of the sealing member used in the toner supplying container in accordance with the first embodiment of the present invention.

The sealing member 1 of this example is shown in FIG. 4. The sealing member 1 of this example includes a sealing portion 1*g* that seals the toner discharge opening of the main body of the toner container, and a drawer portion 1*h* that projects from the sealing portion and is folded and pulled when the toner discharge opening is unsealed. A connection portion 1*i* of the sealing portion and the drawer portion is oblique by 45° with respect to the drawing direction, and the connection portion 1*i* is formed with a leading edge portion 1*j* of the tear portion 1*f*.

Figure 5:
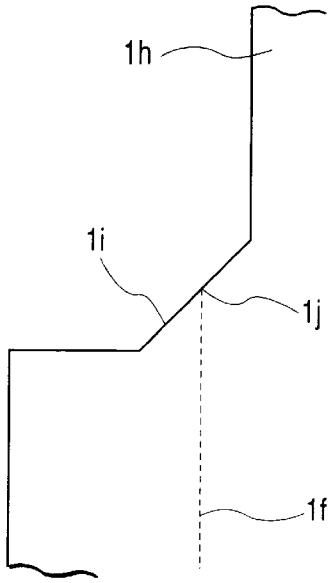
FIG. 5 is a partially enlarged view showing the sealing member used in the toner supplying container in accordance with the first embodiment of the present invention.

The enlarged view is shown in FIG. 5. The leading edge shape of this structure is readily torn up, and the oblique portion may be arc-shaped as another example. Two tear portions 1*f* shown in FIG. 4 are disposed at a position where the toner discharge opening 2*a* of the main body of the toner container is fully opened.

Figure 6:
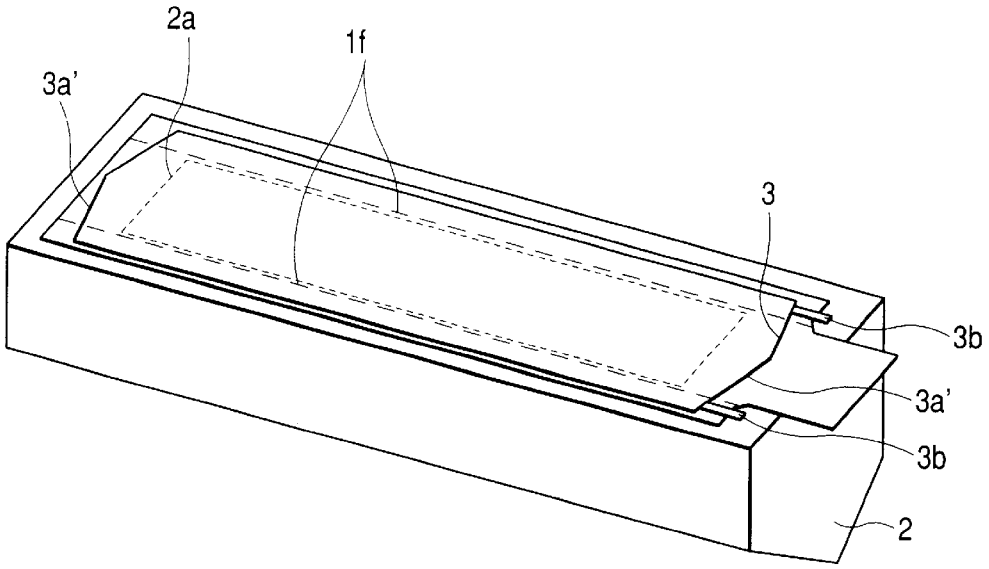
FIG. 6 is a perspective view showing the toner supplying container in accordance with the first embodiment of the present invention.

In the present invention, the sealing member is welded and fixed to the main body of the toner container by the impulse sealing system. A state in which the sealing member 1 of this example is assembled with the main body of the toner container 2 is shown in FIG. 6.

Specifically, the sealing member 1 is fixed onto the main body of the toner container 2 in the periphery of the toner discharge opening 2*a* with the impulse seal. The impulse seal will be described below.

Figure 15:
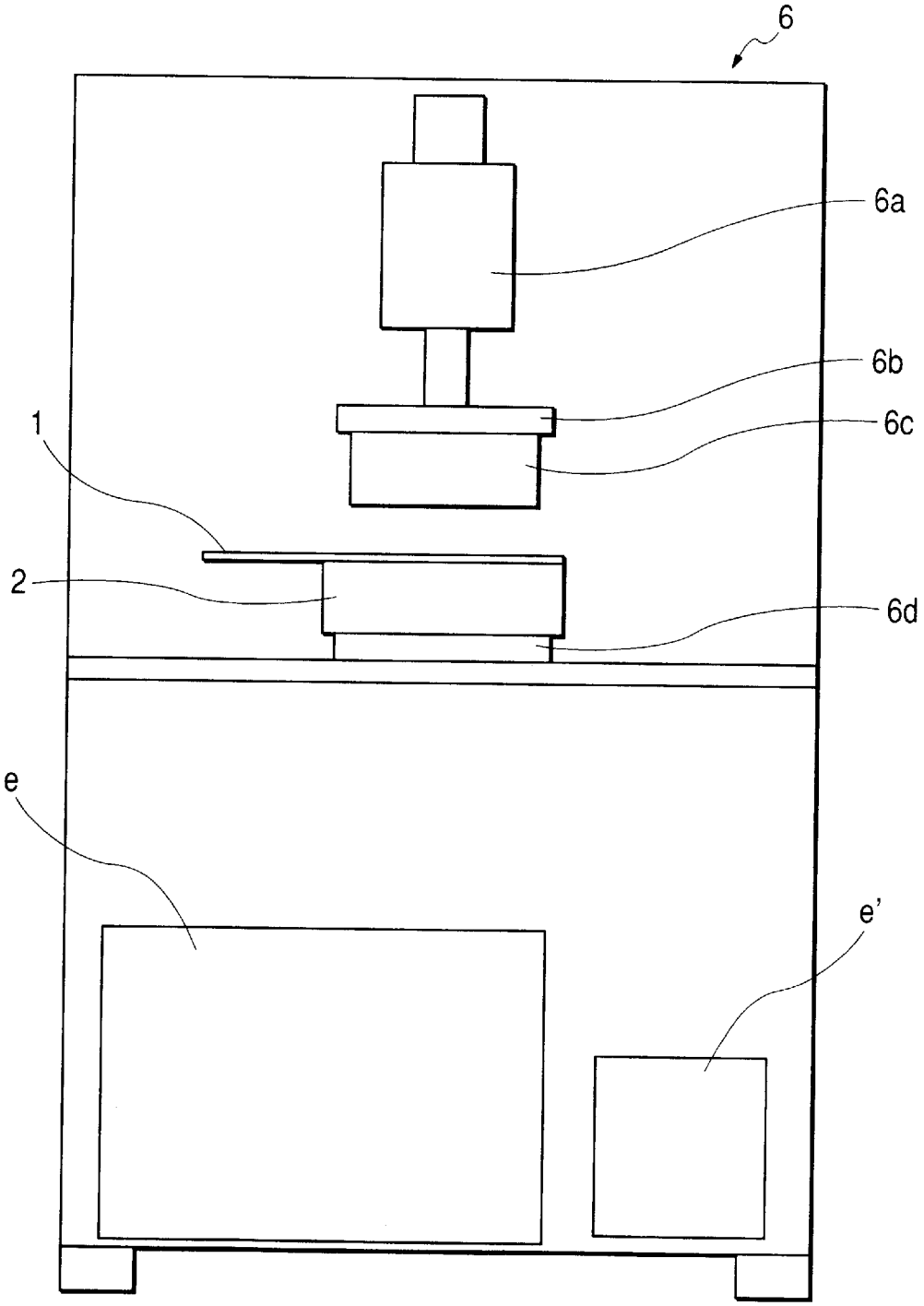
FIG. 15 is a plan view showing the structure of an impulse sealer machine in accordance with the first embodiment of the present invention.

First, an impulse sealer machine 6 is shown in FIG. 15. Basically, the impulse sealer machine 6 is so structured as to have a heating member (hereinafter referred to as "electrode") having a pattern shape (given current path shape) to be welded and an electrode unit 6*c* made of a block material which supports the heating member. The impulse sealer machine 6 sandwiches the sealing member 1 put on the outer surface of the container main body 2 from the electrode unit 6*c* under a constant pressure so as to close the opening and heat the electrode to weld the sealing member 1, and an impulse current is supplied to the electrode in a state in which the electrode unit 6*c* is brought in contact with the sealing member 1 so that the electrode is heated to melt the sealing member 1. Then, the impulse sealer machine 6 maintains a state in which the sealing member 1 is pressed against the container main body 2 by the electrode unit 6*c* even after the impulse current stops, and separates the electrode unit 6*c* from the sealing member 1 after the welding portion between the sealing member 1 and the container main body 2 has been cooled.

Figure 16:
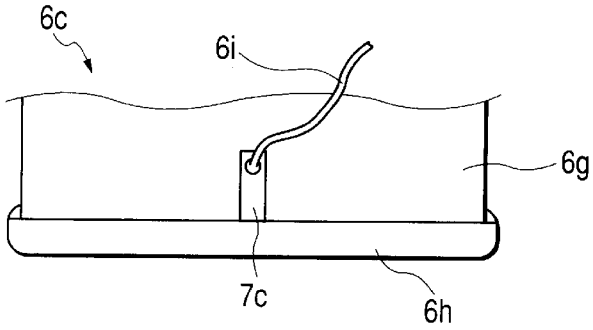
FIG. 16 is a partially enlarged view showing the structure of an electrode unit in accordance with the first embodiment of the present invention.
Figure 17:
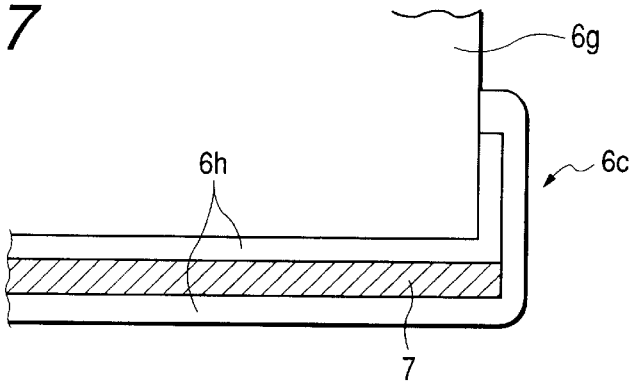
FIG. 17 is a partially cross-sectional view showing the structure of an electrode unit in accordance with the first embodiment of the present invention.

Now, the electrode unit 6*c* will be described. The enlarged view of the electrode unit 6*c* is shown in FIG. 16, and the partial cross-sectional view of the electrode unit 6*c* is shown in FIG. 17. The electrode unit 6*c* is mainly made up of an electrode support block 6*g*, an electrode 7 and an insulating material 6*h*. The shape of the sealing portion of the electrode 7 is the same current path pattern shape as that of the seal welding portion. An electric current flow port 7*c* is disposed in the center portion of the electrode pattern portion in the longitudinal direction thereof (the center portion in the right and left direction of FIG. 18), and bent at the electrode support block side with respect to the seal welding surfaces by 90° (refer to FIG. 16). The impulse current is allowed to flow from an electric power source (not shown) through an electric wire 6*i* to the electrode and in turn from the current flow port 7*c* to the sealing portion 7*a* of the electrode 7, to thereby heat the sealing portion 7*a*.

The reason for the current flow port 7*c* being disposed at the center portion of the pattern portion of the electrode 7 in the longitudinal direction thereof is because substantially the same current flows to the current path of the electrode which is a heating member, that is, an electric resistor to heat the electrode at the same temperature regardless of the position of the electrode.

In addition, as shown in FIG. 17, the structure of the peripheral portion of the electrode 7 of the electrode unit 6*c* is designed such that the insulating material 7*h* is disposed in the electrode support block 6*g*, the electrode 7 is disposed under the insulating material 6*h*, and the electrode 7 is covered with the insulating material 6*h* to fix the electrode 7 to the electrode support block 6*g*.

The electrode 7 is desirably made of a material that has small heat capacity, and is specifically made of stainless steel or nichrome ribbon, and in this embodiment, the electrode 7 is made of stainless steel 0.3 mm in thickness. It is necessary that the electrode support block 6*g* supports the electrode 7 so that the electrode 7 can be brought into pressure contact with the sealing member 1 uniformly. It is desirable that the electrode 7 is made of a material that can radiate the heat produced in the electrode 7 without being stored.

Also, in order that the electrode 7 keeps a stable heating state, a cooling mechanism that cools the electrode support block 6*g* may be used. Then, in this example, the electrode support block 6*g* is formed of an aluminum block.

It is necessary that the insulating material 6*h* is disposed between the electrode 7 and the electrode support block 6*g* so as to prevent a current that flows in the electrode 7 from being leaked, and also disposed between the electrode 7 and the sealing member 1, which is a member to be welded in order to prevent the electrode 7 from being in direct contact with the sealing member 1 so as not to damage the electrode 7 and in order to fix the electrode 7 to the electrode support block 6*g* so as not to be displaced. It is desirable that the insulating material 6*h* is made of a material having heat resistance and high strength, typically Teflon cloth. In this example, the insulating material 6*h* is made of Teflon cloth 0.1 mm in thickness.

The material and the shape of the electrode unit 6*c* such as the thickness of the members are not limited to this example, but other material and shape may be applied if the performances necessary for the respective members are satisfied.

Figure 7:
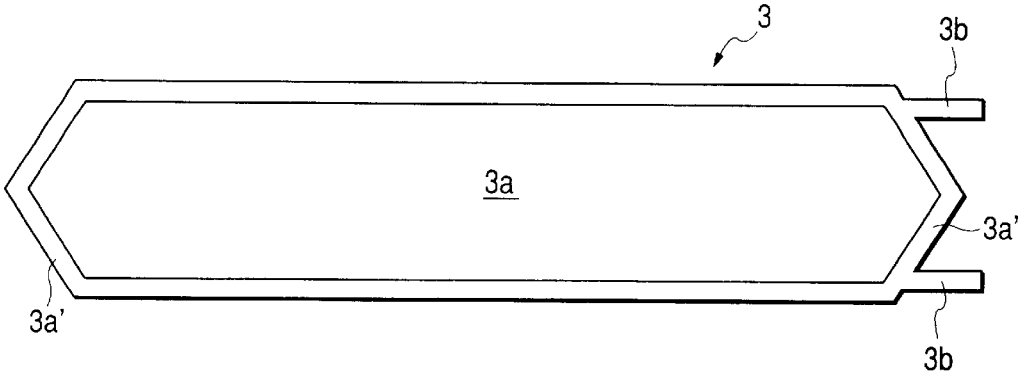
FIG. 7 is a plan view showing a seal melt welding portion pattern of the toner supplying container in accordance with the first embodiment of the present invention.

The welding portion pattern shape (current path shape) of the electrode 7 is shown in FIG. 7. The welding portion pattern 3 is made up of a sealing portion 3*a* structured so as to surround the toner discharge opening and a projection portion 3*b* as a reinforcement portion that stabilizes the tear property of the sealing member 1.

In particular, in order to improve the tear property of the sealing member 1 and to lessen the strength of the sealing member at the time of starting to tear the sealing member 1 (in order to improve the usability), a chevron is formed in the shorter portions 3*a*' (a leading edge side and a trailing edge side) of the toner discharge opening sealing portion 3*a*, and also in order to surely tear and unseal the sealing member 1 (in particular, at the time of starting the tearing), a projection 3*b* is formed so as to press the outer sides of the leading tear edge portion 1*j* (refer to FIG. 10) of the sealing member (refer to FIG. 7).

The chevron configuration of the shorter portion 3*a*' may be changed to a flat configuration depending on the width of the actual sealing portion and a weldable space.

Figure 18:
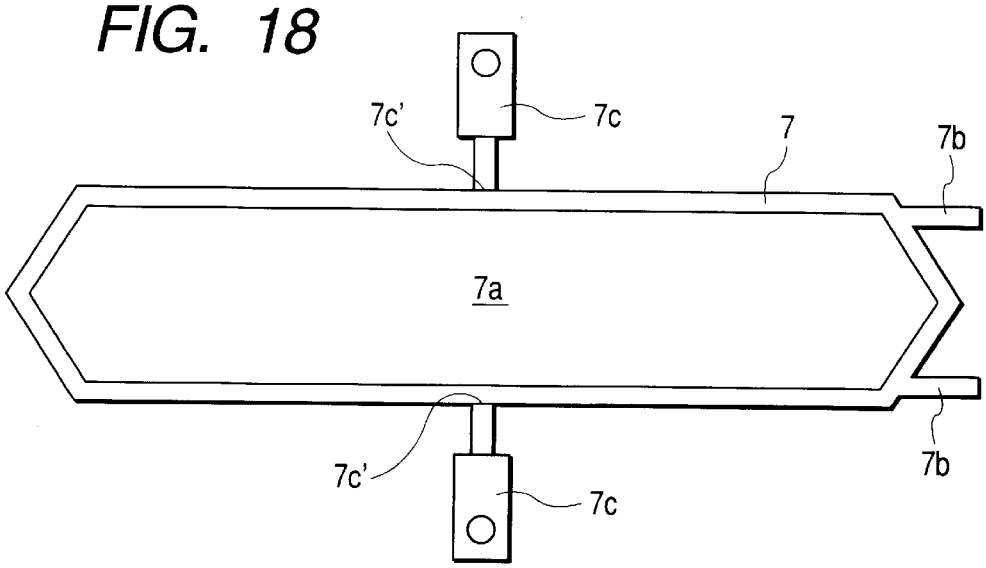
FIG. 18 is a plan view showing the structure of an electrode in accordance with the first embodiment of the present invention.

Similarly, the electrode shape of this example is shown in FIG. 18. The seal welding portion pattern 3 shown in FIG. 7 is identical in shape with the corresponding sealing portion (the toner discharge opening sealing portion 7*a* and the projection portion 7*b*) of the electrode 7, and also the current flow portion 7*c* is disposed at the center portion thereof in the longitudinal direction. The portion 7*c*' is bent by 90° with respect to the electrode support block 6*g* and fixed. In the electrode shape, it is necessary that the corresponding seal portion is identical in shape with the actual sealing portion, but the position and shape of the current flow portion may be changed if the performance of the impulse seal can be satisfied, that is, the sufficient and uniform heating state is obtained, and no problem occurs in the welding process.

A jig suited for the shape of the seal welding portion pattern 3 is equipped in the impulse sealer machine 6, and the sealing member 1 is welded and fixed to the outer surface of the main body of the toner container 2 so as to close the opening.

The sealing conditions are that the pressure of the sealing member 1 against the electrode unit 6*c* is 0.5 MPa (ϕ50 cylinder), a voltage applied to the electrode is 15V, a heating period of time (voltage (current) applying period of time) is 0.5sec, and a holding period of time (a period of time during which the pressure continues to be applied after the voltage (current) supply stops) is 1 sec. The sealing conditions are not limited to this example, but they are desirably appropriately selected depending on the materials of the seal and the container main body, the seal area, the seal width and so on.

Figure 8:
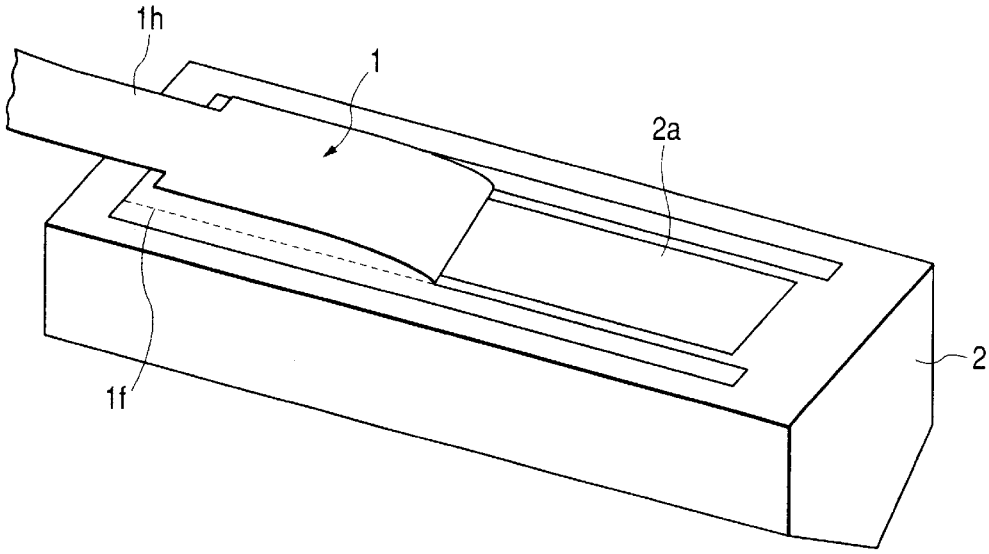
FIG. 8 is a perspective view showing a state in which the toner seal of the toner supplying container is being unsealed in accordance with the first embodiment of the present invention.
Figure 9:
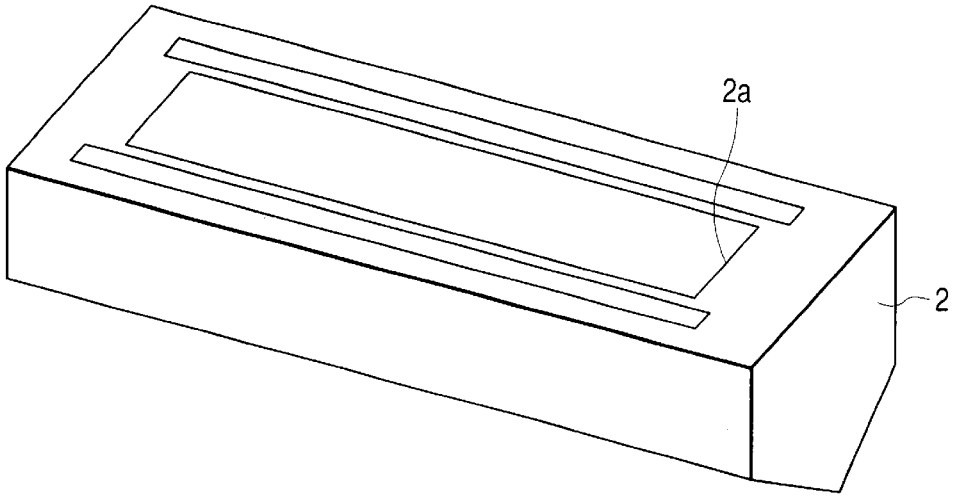
FIG. 9 is a perspective view showing a state in which the toner seal of the toner supplying container has been unsealed in accordance with the first embodiment of the present invention.

Then, an appearance of the sealing member 1 at the time of removing the sealing member 1 according to this example is shown in FIGS. 8 and 9.

The drawer portion 1*h* where the sealing portion 1 is folded is pulled and torn up along the tear portion 1*f* of the sealing member 1 to open the opening 2*a* of the main body of the container 2, thereby becoming capable of discharging the toner.

In particular, in this example, because the impulse sealing system is applied, the unsealing performance is improved, thereby becoming capable of surely unsealing the toner discharge opening. Also, the opening width (the opening width in a direction substantially orthogonal to the tearing direction) can be excellently controlled. The details will be described below.

Figure 10:
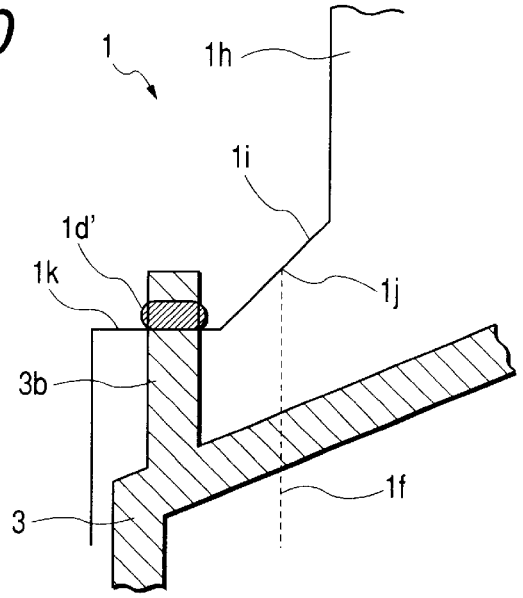
FIG. 10 is a partially enlarged view showing the sealing portion of the toner supplying container in accordance with the first embodiment of the present invention.

FIG. 10 is an enlarged view showing the tearing unsealing start portion of the sealing member 1.

The sealing member 1 includes a sealing portion 1*g* that seals the toner discharge opening 2*a* of the container main body 2, and a free end of the drawer portion 1*h* which is projected from the sealing portion 1*g* and folded. The connection portion 1*i* of the sealing portion 1*g* and the free end is formed with a leading edge portion 1*j* of the tear portion 1*f*. The shape of the connection portion 1*i* is arcuate or oblique with respect to the tearing direction of the sealing member 1.

When the sealing member 1 of this example is removed, the drawer portion 1*h* where the sealing member 1 is fplded is pulled, and a part of the sealing member 1 is torn up along the tear portion 1*f* of the sealing member 1 so that the welding portion of the sealing member 1 remains. In order to surely tear the leading edge portion 1*j* of the sealing member 1 at the time of starting to tear the sealing member 1, it is preferable that the sealing portion 3*b* at the outer side thereof is firmly fixed. That is, if the sealing portion 3*b* is welded firmly more than the tear strength of the leading edge portion 1*j*, the leading edge portion 1*j* can be excellently torn up without tearing the sealing portion 3*b*. Conversely, if the welding strength of the sealing portion 3*b* is weaker than the tear strength of the leading edge portion 1*j*, the sealing portion 3*b* is peeled off without being torn up, resulting in a sealing member that is incapable of increasing the unsealing strength and controlling the opening width.

Accordingly, the adhesive strength of the sealing portion 3*b* becomes important, and the impulse sealing system applied to this example is most suitable in increasing the adhesive strength.

When the sealing portion 3*b* is conducted by the heat sealing system as in the conventional example, after the sealing member 1 is pressed against the container main body 2 by the heated sealing jig, the sealant layer 4*d* of the sealing member 1 is yet in the melting state when the sealing jig is lifted up, and therefore there is a possibility that the adhesive strength is lessened because the pressure of the jig is not affected before the sealant layer 4*d* is cooled and solidified.

Also, as shown in FIG. 10, the sealing portion 3*b* is projected from a portion 1*k* of the sealing member 1 and firmly pressed, and in this situation, there is a case in which an extrusion 1*d*' of the sealant layer 1*d* occurs and is stuck onto the jig of the heat seal with the result that the sealing member 1 is peeled off or drops out with an elevation of the seal jig.

On the contrary, in the impulse sealing system of this example, the jig (electrode unit 6*c*) is brought into pressure contact with the sealing member 1 toward the container main body 2 and held, and then the impulse current is allowed to flow, and the electrode is heated, to thereby melt the sealant layer 1*d* of the sealing member 1.

Since the current stops immediately after that time, the pressing state of the jig is held while the melted sealant layer 1*d* is cooled and solidified, when the welding is completed and the jig is lifted up, so that sufficient adhesive strength is exhibited, and the melted sealant layer 1*d* may not be stuck onto the jig.

Therefore, the use of the impulse sealing system produces sufficient adhesive strength for the sealing portion together with the sealing portion 3*a*, thereby resulting in a sealing member that is capable of preventing the welding portion from being peeled off at the time of tearing and unsealing the sealing member 1. Thus, the sealing member 1 can be unsealed readily and surely.

As a result of conducting the unsealing test by using the toner container 2 of this example, stabilization is made at the unsealing strength of about 2 to 3 kgf, and the sealing member 1 is surely torn up at the tear portion 1*f*, thereby being capable of opening the sealing member.

Also, there are found no floating of the welding portion(a gap is produced between the sealing member 1 and the container main body 2), no separation of the sealing member 1, and no attachment of the sealant layer 1*d* onto the surface of the electrode unit 6*c*, and the welding state of the sealing member 1 is also excellent.

In the above description, after the tear portion 1*f* is formed on the sealing member 1 by irradiation of a laser beam, the sealing member 1 is welded onto the container main body 2. Also, it is possible that the order of the processes is reversed, and after the sealing member 1 is welded onto the container main body 2 in advance, the tear portion 1*f* may be formed on the sealing member 1 by irradiation of a laser beam.

Also, in this example, the supply of a current to the electrode 7 is conducted after the sealing member 1 is pressed against the container main body 2, but the order of the processes may be reversed so that after the current is applied to the electrode 7 in advance, the sealing member 1 is pressed against the container main body 2. A period of time during which the sealing member is pressed against the container main body 2 after the current is supplied to the electrode 7 is preferably as short as possible. This is because if the current is very quickly supplied, the durability lifetime of the electrode 7 is shortened.

It is needless to say that a process of supplying the current to the electrode 7 and a process of pressing the sealing member 1 to the container main body 2 may be conducted substantially at the same time.

Second Embodiment

Figure 11:
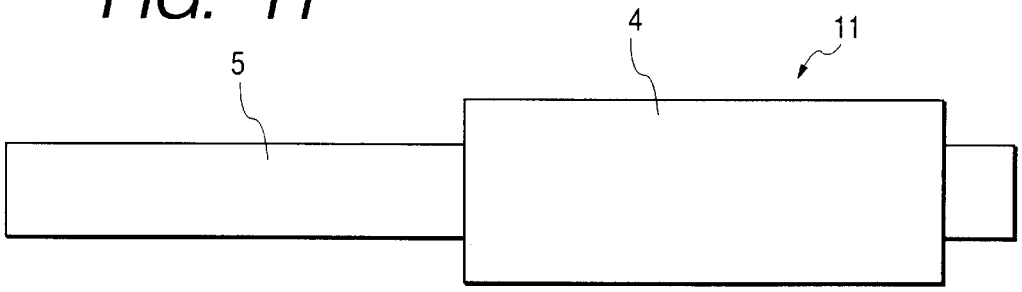
FIG. 11 is a plan view showing the structure of a sealing member used in a toner supplying container in accordance with a second embodiment of the present invention.
Figure 12:
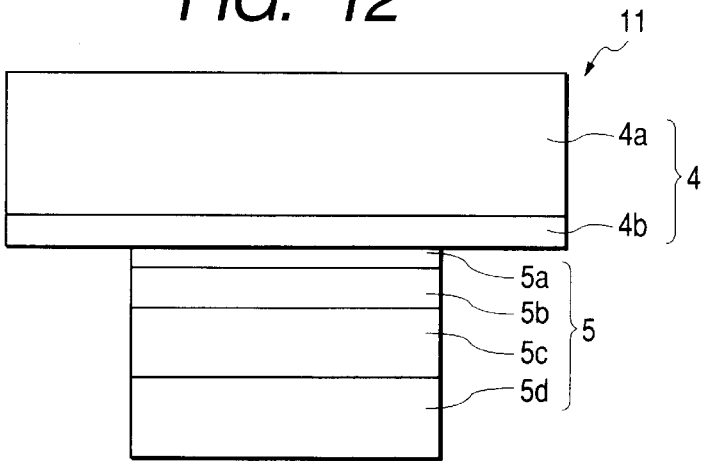
FIG. 12 is a cross-sectional view showing the layer structure of the sealing member used in the toner supplying container in accordance with the second embodiment of the present invention.

In this example, there are used a cover film 4 that seals the toner discharge opening 2*a* and a tear tape 5 lined by the cover film 4 and tears the cover film 4 by substantially the same width as the toner discharge opening width to form an opening as the sealing member 1. Other portions are identical with those as in the first embodiment. The sealing member 11 of this example is shown in FIGS. 11 and 12 (film layer structure).

The cover film 4 that seals the toner discharge opening 2*a* is structured by the following layers:

Oriented expanded polypropylene 140 μm (4*a*)

EVA-base sealant 20 μm (4*b*)

The tear tape 5 that forms the opening is structured by the following layers:

Polyester 16 μm (5*a*)

Oriented nylon 25 μm (5*b*)

Low-density polyethylene 30 μm (5*c*)

EVA-based sealant 40 μm (5*d*)

The cover film 4 and the tear tape 5 are integrated by thermoweld (between 4*b* and 5*a*) into the sealing member 11, and then welded to the main body of the toner container 2 so as to close the opening 2*a* through the impulse sealing system as in the first embodiment.

Figure 13:
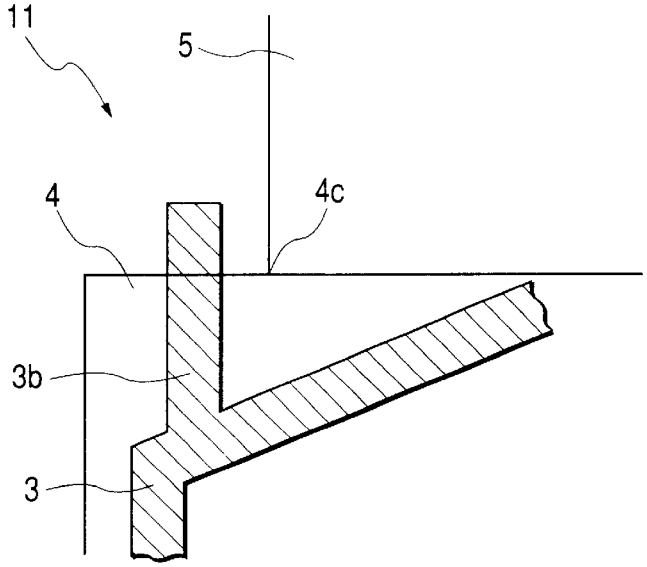
FIG. 13 is a partially enlarged view showing the sealing member used in the toner supplying container in accordance with the second embodiment of the present invention.

Similarly, in this example, the enlarged view showing the tear unsealing start portion of the sealing member 11 is shown in FIG. 13.

As in the first embodiment, since the sides of the tear tape S can be sufficiently welded and fixed by the projection sealing projection 3*b*, the cover film 4 can be surely torn up and unsealed (the tear start portion 4*c*).

In particular, since the cover film 4 of this example lowers the film strengths in order to improve the tearing property of the film, pulling in the melting state as in the heat sealing system does not occur by sealing through the impulse sealing system, and damage on the film can be reduced, thereby producing a film capable of surely sealing the toner discharge opening.

Similarly, in this example, as a result of conducting the unsealing test by using the toner container, stabilization is made at the unsealing strength of about 2 to 3 kgf as in the first embodiment, and also the sealing member 1 can be surely torn up and opened at the tear portion.

Third Embodiment

Figure 14:
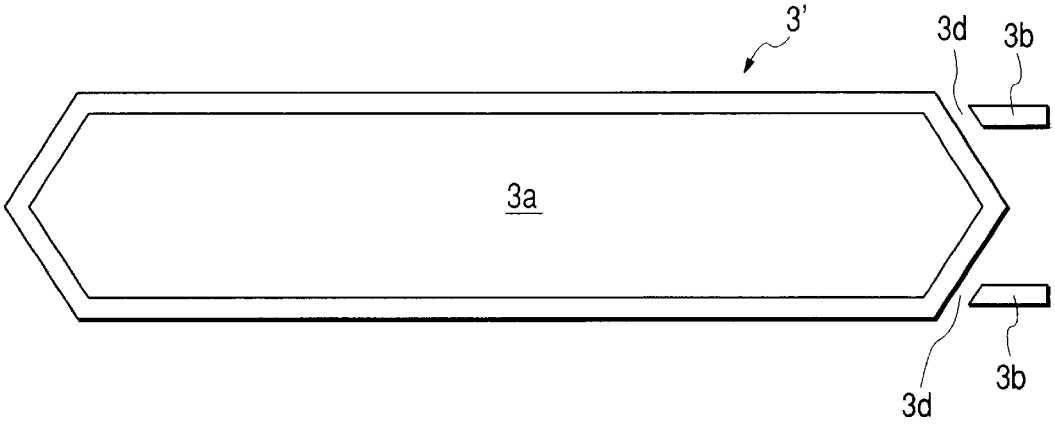
FIG. 14 is a plan view showing a seal melt welding portion pattern of a toner supplying container in accordance with a third embodiment of the present invention.

This example shows a partial modification of the shape of the structure of the impulse seal welding portion patter 3 in the first embodiment, that is, the structure of the electrode unit 6*c*. The sealing welding portion pattern shape 3' of this example is shown in FIG. 14. In this example, in the seal welding portion pattern shape 3', the toner discharge opening sealing portion 3*a* and the projection portion 3*b* are divided, and the sealing portion 3*a* and the projection portion 3*b* form respective independent electrode paths as the electrode structure. Reference numeral 3*d* denotes a boundary of the sealing portion 3*a* and the projection portion 3*b*.

In this embodiment, the reason for that the seal welding portion pattern shape 3' is divided is because the welding strengths of the projection portions 3*b* are independently controlled, respectively, so that the welding strength of the projection portion 3*b* is intentionally firmly or unfirmly welded onto the toner discharge opening sealing portion 3*a*. With the above structure, the sealing portion 3*a* and the projection portion 3*b* can be excellently welded onto the container main body 2.

The sufficient adhesive strength can be obtained even by the integral jig of the toner discharge opening sealing portion 3*a* and the projection portion 3*b* as in the first embodiment, but in the case where a firmer adhesive strength is going to be obtained or the length of the projection portion 3*b* is lengthened, it is desirable that the projection portion 3*b* is divided and independently controlled by another circuit, to thereby make a sufficiently proper current flow up to the terminal of the projection portions 3*b*, as a result of which the electrode is heated up to a desired temperature to obtain a firm adhesive strength. It is desirable that the welding force of the projection protrusion 3*b* onto the container main body 2 is made higher than that of the toner discharge opening sealing portion 3*a* for the purpose of improving the tear stability when the sealing member 1 starts to be torn.

A specific structure of the electrode unit 6*c* will be described.

Figure 19:
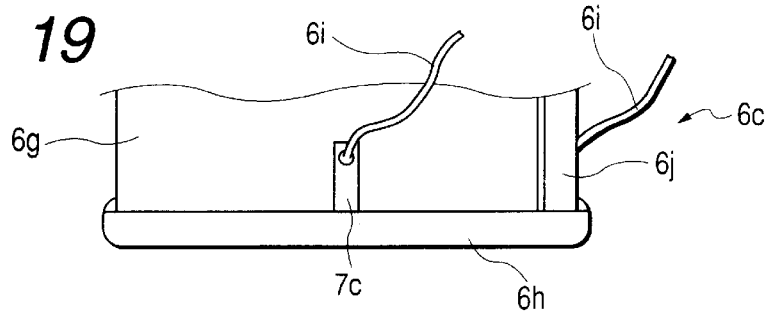
FIG. 19 is a partially enlarged view showing the structure of an electrode unit in accordance with a third embodiment of the present invention.
Figure 20:
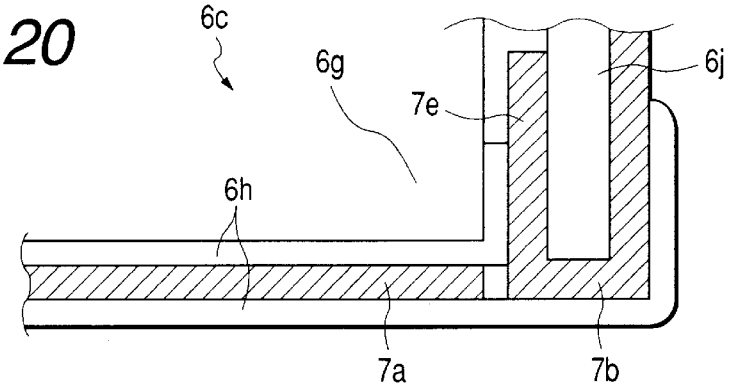
FIG. 20 is a partially cross-sectional view showing the structure of an electrode unit in accordance with a third embodiment of the present invention.

The enlarged view of the electrode unit 6*c* in this example is shown in FIG. 19, and the partially cross-sectional view thereof is shown in FIG. 20. As shown in FIG. 19, this example is different from the first embodiment in that the electrode 7*a* of the toner discharge opening sealing portion 3*a* side, the electrode block 6*g* that supports the electrode 7*a*, the electrode 7*b* at the projection portion 3*b* side and the electrode support block 6*j* that supports the electrode 7*b* are independent from each other as different members. The relationship of the insulating material 6*h* and the respective electrodes is identical with those of the first embodiment.

Figure 21:
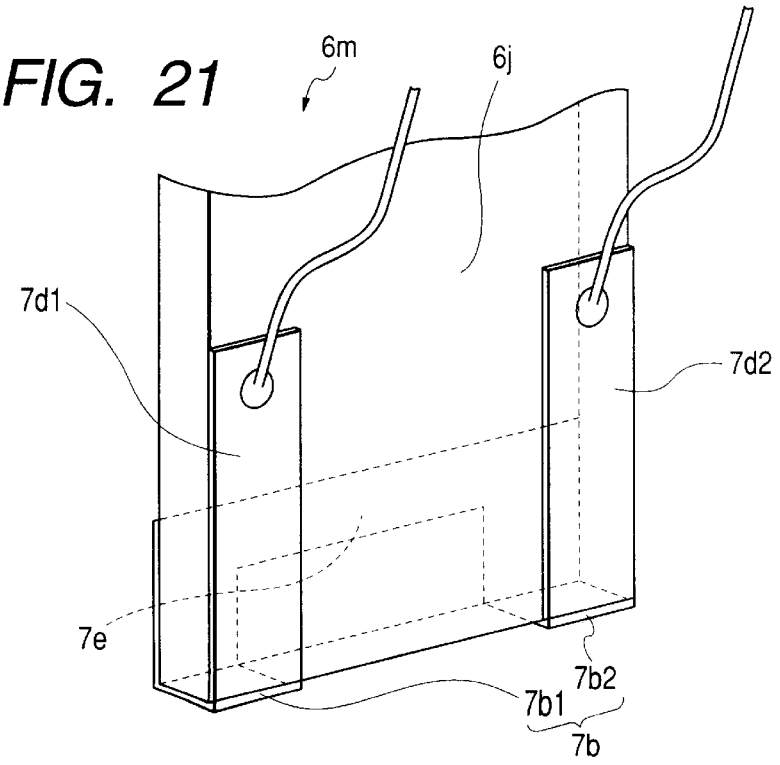
FIG. 21 is an enlarged perspective view showing the structure of an electrode unit in accordance with the third embodiment of the present invention.

In addition, the enlarged perspective view of the electrode unit 6*m* of the projection portion 3*h* in this embodiment is shown in FIG. 21. Two projection electrodes 7*b* are disposed apart from each other in order to press the outer sides of the leading tear edge portion 1*j* of the sealing member 1, and portions other than the sealing portion are folded along the electrode support block 6*j* and coupled at portions different from the sealing surface, to thereby form a circuit.

Specifically, as shown in FIG. 21, there is formed a circuit in which after an electric current flows from the current flow portion 7*d*1 folded along the electrode support block 6*j* flows and passes through the sealing portion 7*b*1, the current flows in the coupling portion 7*e* of the back surface of the electrode support block, and then flows out of 7*d*2 after having passed through 7*b*2. The same is applied to the case in which the current flows from 7*d*2 vice versa.

The above structure makes it possible to control those two projection portions 3*b* apart from each other to be controlled by one circuit.

The structure of the electrode unit 6*c* is not limited to this embodiment provided that the above performance is satisfied, and in particular, in the electrode unit 6*m* of the projection portions 3*b*, the folded shape of the electrode, the position of the current flow port and the like can be appropriately selected.

In this embodiment, since the projection portion 3*b* is controlled by another electric circuit different from the toner discharge opening sealing portion 3*a*, the toner discharge opening sealing portion 3*a* side can be controlled, individually, and the sealing conditions such as the current value, the current supply period of time and the pressure can be set individually.

In the case where the pressure is set, individually, for example, the amount of entry (pressure) of the electrode unit 6*m* at the projection portion 3*b* side toward the sealing member 1 may be set to be larger than that at the toner discharge opening sealing portion 3*a* side. In this case, since there is a possibility that a portion close to the projection portion of the toner discharge opening sealing portion 3*a* slightly floats to make the sealing property unstable, it is preferable that the pressure is set to be substantially the same, and at least one of the current value and the current supply period of time is set individually.

In this embodiment, the sealing conditions of the toner discharge opening sealing portion 3*a* are set such that the pressure is 0.5 MPA (φ50 cylinders), the voltage is 15 V, the heating period of time is 0.5 sec, and the holding period of time is 1 sec, and the sealing conditions of the projection portion 3*b* are set such that the voltage is 18 V, the heating period of time is 0.7 sec, and the holding period of time is 0.8 sec.

With the above conditions, the welding strength of the projection portion 3*b* increases, thereby making it possible to more surely tear and unseal the sealing portion.

It is desirable that the electrode 7*a* of the toner discharge opening scaling portion 3*a* and the electrode 7*b* of the projection portion 3*b* are insulated from each other in the electrode unit of the impulse seal.

Figure 22:
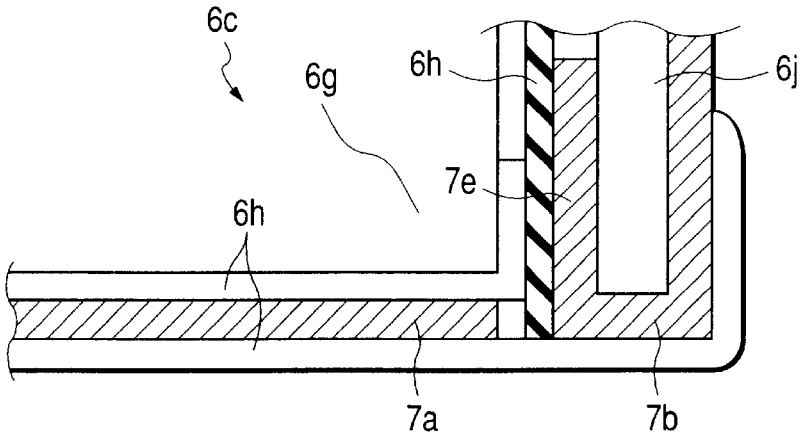
FIG. 22 is a partially cross-sectional view showing the structure of the electrode unit in accordance with the third embodiment of the present invention.

Specifically, it is desirable that an insulating material 6*h* is disposed between both of electrodes as shown in FIG. 22. Although a slight gap occurs between those electrodes as the seal pattern, because the gap is restrained to the minimum value by managing the dimensions between the electrodes, the gap does not adversely affect the tear unsealing property and the sealing property at all.

Also, in case of this embodiment, since the welding of the projection sealing portion can be controlled, it is possible to slightly weaken the welding strength of only the projection portion 3*b* due to the prevention of extrusion of the sealant 1*d* conversely.

In this embodiment, the toner discharge opening sealing portion 3*a* and the projection portion 3*b* are basically welded at the same time. However, those portions 3*a* and 3*b* may be welded in different processes in the case where a space for the welding portion and the electrode unit from the viewpoint of design is short or in the way of the maintenance of the device. In this case, the unsealing property of the sealing member 1 in this case can be improved, and the effect of the impulse seal is sufficiently obtained.

In the toner container of this embodiment, as a result of conducting the unsealing test, stabilization is obtained at the unsealing strength of about 2 kgf, and the sealing portion can be more surely torn up and unsealed at the tear portion 1*f*.

In addition, this embodiment can maintain the high sealing property, an no problem such as toner leakage occurs at all in the tests of physical distribution and environments of the toner container.

Fourth Embodiment

This embodiment shows an example which uses a sealing jig of the third embodiment and the sealing member 11 of the second embodiment, and other structures in this embodiment are identical with those in the second embodiment. Similarly, in this example, the seal projection portions 3*b* that exist at sides of the tear unsealing start portion 4*c* of the sealing member 11 are divided to enable the control as in the third embodiment, thereby making it possible to obtain sufficient adhesive strength and also surely tearing up and unsealing the sealing portion.

Similarly, in this example, as a result of conducting the unsealing test by using the toner container, the stabilization is obtained at the unsealing strength of about 2 to 3 kgf as in the first embodiment, and the sealing portion can be surely torn up and unsealed at the tear portion.

The present invention is not limited to a tear film due to the laser processing, and the cover film tear tape system. This is particularly a method effective in the system of tearing up and unsealing the film.

Fifth Embodiment

A fifth embodiment shows an example in which the electrode unit structure of the third embodiment and the easy peel film that peels off and unseals a portion to which the sealing portion is welded at the time of removing the sealing portion is employed as the sealing member 8. The sealing member 8 of this example is structured into four layers, and specifically the same material as that of the tear tape 5 in the second embodiment is used.

Figure 23:
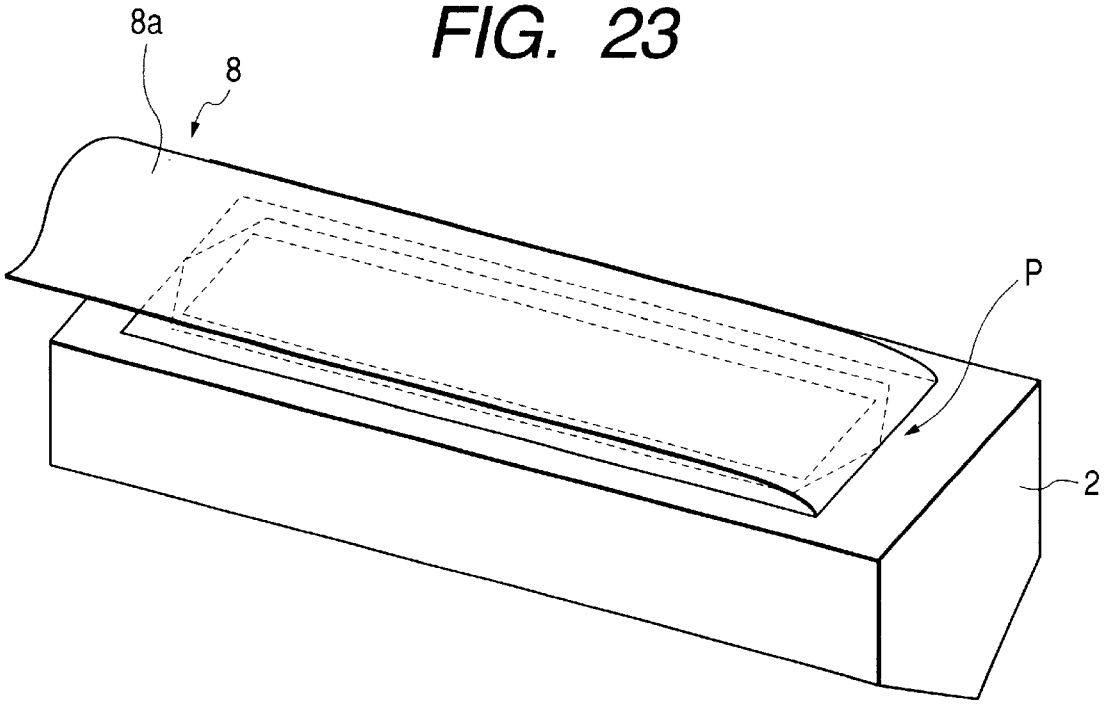
FIG. 23 is a perspective view showing the toner supplying container.

The sealing member 8 used in this example is different from that in the third embodiment in that there is no necessity of pressing the sides of the tear portion because of no structure in which the sealing portion is torn up and unsealed. However, there is the fear that a part of the welding portion (P in FIG. 23) is peeled off by forcibly over-pulling the free end 8*a* in error when folding and assembling the free end 8*a* after the sealing member 8 is welded onto the toner container main body 2 during the manufacture of the toner container as shown in FIG. 23.

Figure 24:
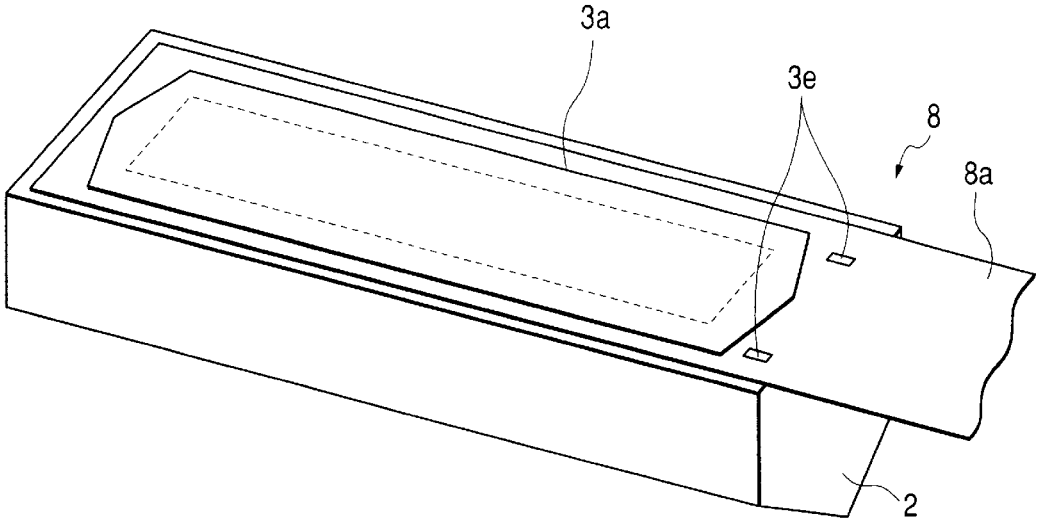
FIG. 24 is a perspective view showing a toner supplying container in accordance with a fifth embodiment of the present invention.

Therefore, a point seal portion 3*e* (FIG. 24) is provided at the portion which is the upstream side of the toner discharge opening sealing portion 3*a* at the time of removing the sealing member 8 as a reinforcement portion to partially fix the sealing member 8 and the toner container main body 2.

Under the above circumstances, the point sealing portion 3*e* becomes a resistance portion even if the free end 8*a* of the sealing member 8 is forcibly pulled in error during the assembling process during manufacture, and the even if the point seal portion 3*e* is peeled off in the worst case, the toner discharge opening sealing portion 3*a* can be prevented from being peeled off.

Figure 25:
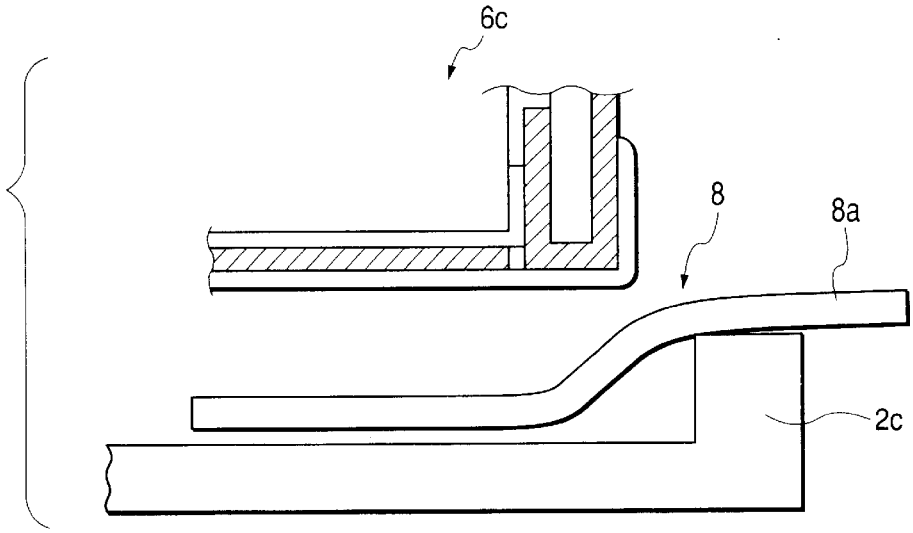
FIG. 25 is a partially enlarged view showing a state in which the toner supplying container is being sealed in accordance with the fifth embodiment of the present invention.

Also, in the case where a seat 2*c* that is in close contact with the developing device of the image forming apparatus (which will be described in a sixth embodiment below) or the like is disposed in the vicinity of the welding portion of the sealing member 8 as shown in FIG. 25, the free end 8*a* is brought to the seat 2*c* and lifted up at the time of welding the sealing member 8. For that reason, in the case where welding is made by the heat seal, after the sealing member is pressed by the heated seal jig (electrode units 6*c*), when the jig is lifted up, the sealing member 8 is released from the pressure of the seal jig before the sealant layer of the sealing member 8 which is yet in the melting state is cooled and solidified, resulting in the possibility that the sealant layer is peeled off.

Because the pressure of the seal jig is released after the welding portion has been heated and then cooled by using the impulse sealing system in this example, it is difficult to peel off the sealant layer as compared with the heat sealing system. However, in order to more stably prevent the welding portion from being peeled off, it is better that the point sealing portion 3*e* is positioned upstream of the toner discharge opening sealing portion 3*a* which is at the time of removing the sealing member 8 to partially fix the sealing member 8 and the toner container main body 2 to each other as described above.

In the above-described case, in this example, because the current supply period of time, the current value and the like are controlled for each of the toner discharge opening sealing portion 3*a* and the point sealing portion 3*e*, by different circuits, independently as in the third embodiment, the point sealing portion 3*e* can be strongly or weakly welded as compared with the toner discharge opening sealing portion 3*a*. For example, when the toner discharge opening sealing portion 3*a* is weakly welded in order to lessen the unsealing strength, the point sealing portion 3*e* can be strongly welded in order to prevent the welding portion from being peeled off due to the mis-operation during assembling and the welding portion from being peeled off due to the running on of the free end.

In this embodiment, the same electrode unit 6*c* as that in the third embodiment is employed, the sealing conditions are made identical with those in the third embodiment, and the toner container main body 2 is sealed with the sealing member 8. Similarly, in this embodiment, the welding strength of the point sealing portion 3*e* (the projection portion 3*b* in the third embodiment) is increased for the countermeasure of the welding portion peeling.

Similarly, in the toner container of this example, as a result of conducting the unsealing test, the welding portion can be surely peeled off and unsealed at the unsealing strength of about 2 kgf. Also, there is found no peeling of the welding during assembling at all. In addition, in this example, the sealing property can be maintained, and a problem, such as toner leakage, does not occur at all in the tests of the physical distribution and environments of the toner container.

This example is different from the third embodiment in that because the sealing member is not torn up and unsealed, there is no necessity that the sides of the tear portion is pressed. Also, if the purpose of preventing the free end 8*a* of the sealing member 8 from being lifted up and the welding portion from being peeled off during assembling can be achieved, the shape of the point sealing portion 3*e* may be different from the shape of the third embodiment 3, and not two end portions may be replaced by one center portion of the free end 8*a* of the sealing member 8.

Sixth Embodiment

Figure 26:
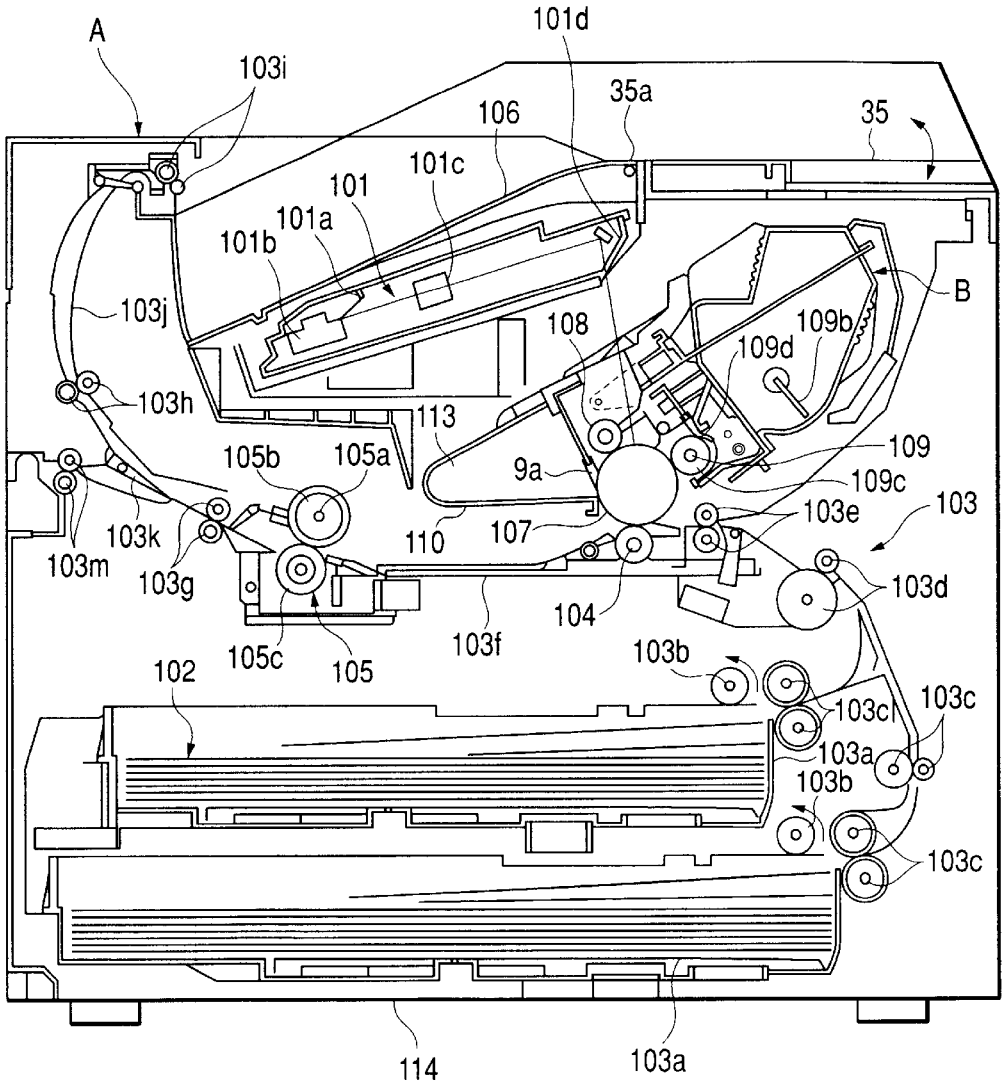
FIG. 26 is a longitudinal sectional view showing the structure of a laser beam printer A.
Figure 27:
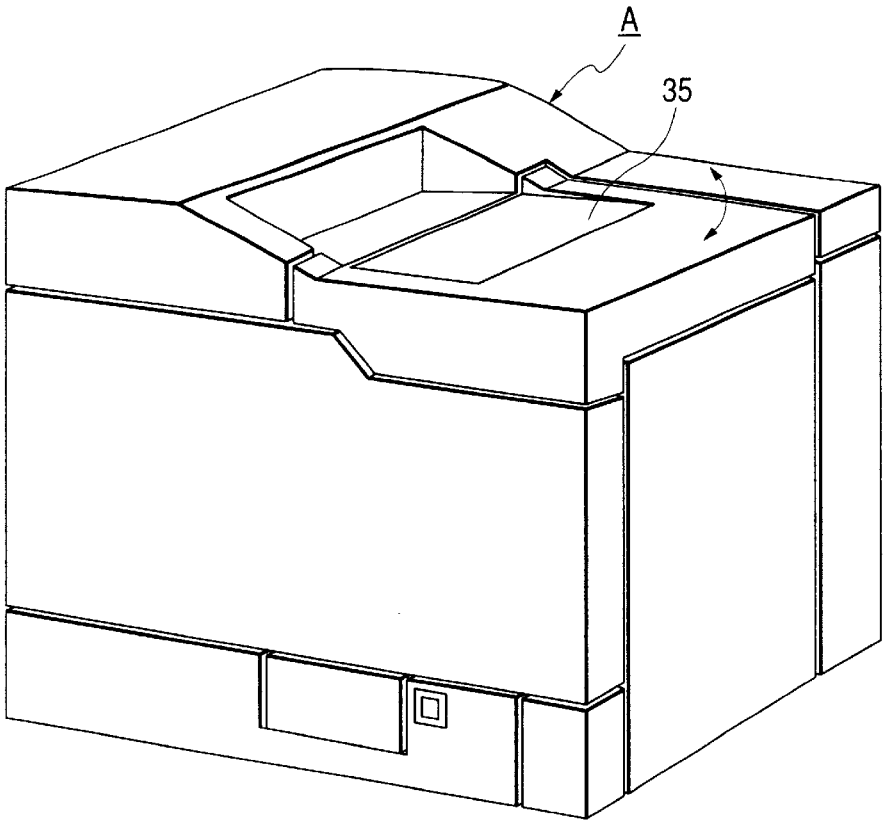
FIG. 27 is a perspective view showing the appearance of the laser beam printer A.
Figure 28:
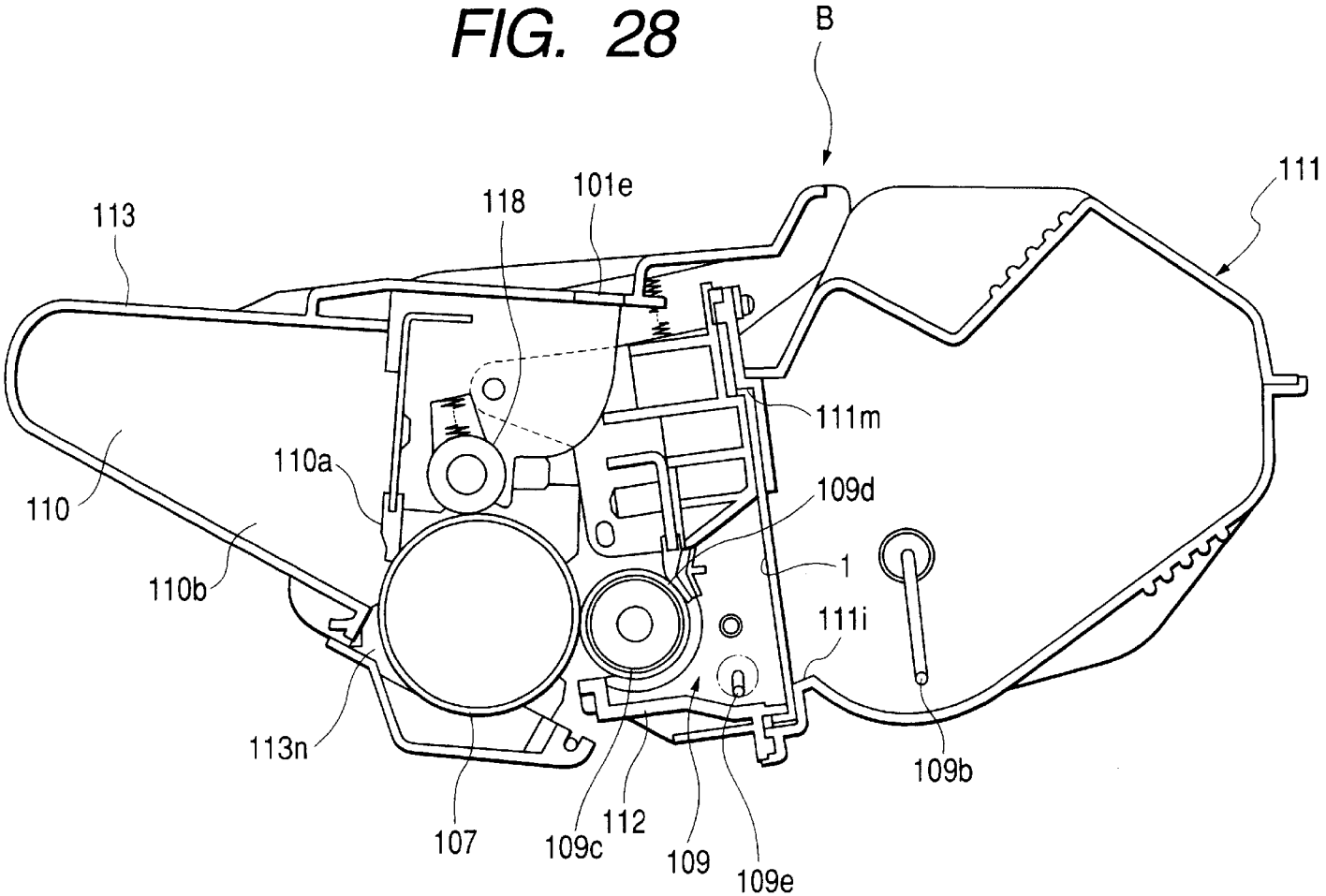
FIG. 28 is a longitudinal sectional view showing the structure of a process cartridge B.

A description will be given of a process cartridge B in accordance with a preferred embodiment of the present invention with reference to FIGS. 26 to 28. FIG. 26 is a structural explanatory diagram showing an embodiment (laser beam printer A) of an electrophotographic image forming apparatus to which the process cartridge B of the present invention is applied, and FIG. 27 is a perspective view of the appearance of the electrophographic image forming apparatus. Also, FIG. 28 is a side cross-sectional view of the process cartridge B to which an embodiment of the present invention is applied.

First, as an example of the electrophotographic image forming apparatus, the laser beam printer A will be described with reference to FIG. 26. As shown in FIG. 26, the laser beam printer A is so designed as to form an image on a recording medium 102 (for example, a recording paper, an O.H.P. sheet, a cloth or the like) by the electrophotographic image forming process. The laser beam printer A shown in FIG. 26 is equipped with the process cartridge B therein. The process cartridge B includes a drum-shaped electrophotographic photosensitive member (hereinafter referred to as "photosensitive drum 107"), a charging roller 108 that charges the photosensitive drum 107 and a developing means 109 that forms a toner image.

First, the photosensitive drum 107 is charged by the charging roller 108, and a laser beam is irradiated onto the photosensitive drum 107 in accordance with image information from an optical means 101, to thereby form a latent image corresponding to the image information on the photosensitive drum 107. Then, the latent image is developed by the developing means 109 to form a toner image. In this situation, the recording medium 102 set in a feed cassette 103*a* is reversed and conveyed by a pickup roller 103*b*, transport rollers 103*c* and 103*d* and a pair of registration rollers 103*e* in synchronism with the formation of the toner image. Then, the toner image formed on the photosensitive drum 107 is transferred onto the recording medium 102 by applying a voltage to a transfer roller 104 that serves as a transfer means.

Thereafter, the recording medium 102 to which the toner image has been transferred is transported to fixing means 105 by a transport guide 103*f*. The fixing means 105 includes a fixing roller 105*b* including a drive roller 105*c* and a heater 105*a* therein. Then, heat and pressure are applied to the passing recording medium 102 to fix the transferred toner image onto the recording medium 102. The recording medium 102 is transported by pairs of delivery rollers 103*g*, 103*h* and 103*i* and then delivered to a delivery tray 106 through a surface reverse path 103*j*. The delivery tray 106 is disposed on an upper surface of a main body 114 of the laser beam printer A. The recording medium 102 can be delivered by the pair of delivery rollers 103*m* without passing through the surface reverse path 103*j* by the actuation of a swingable flapper 103*k*. In this embodiment, the transporting means 103 is made up of the pickup roller 103*b*, the transport rollers 103*c*, 103*d*, the pair of registration rollers 103*e*, the transport guide 103*f*, the pairs of delivery rollers 103*g*, 103*h*, 103*i*, and the pair of delivery rollers 103*m*.

The process cartridge B will be described in more detail with reference to FIG. 28. The process cartridge B is directed to a state in which a toner frame 111 serving as a developer containing chamber that contains the toner therein is coupled to a developing frame 112 serving as a developing chamber that holds the developing means 109 such as the developing roller 109*c*.

The toner frame 111 includes a toner supplying opening 111*i* (supplying opening), and supplies the toner to the interior of the developing frame 112 from the toner supplying opening 111*i*. The process cartridge B is structured by coupling a cleaning frame 113 including the photosensitive drum 107, a cleaning means 110 such as a cleaning blade 110*a* and the charging roller 108 to the toner frame 111 and the developing frame 112. The process cartridge B is detachably mountable on the main body 114 by an operator.

In the process cartridge B, the charging roller 108 serving as the charging means is disposed in contact with the photosensitive drum 107, and the charging roller 108 is rotated by the photosensitive drum 107. In formation of an image, first the photosensitive drum 107 having a photoconductive layer is rotated, and its surface is uniformly charged by applying a voltage to the charging roller 108.

Then, a laser beam irradiates the photosensitive drum 107 through an exposure opening portion 101*e* in response to image information from the optical means 101 disposed in the laser beam printer A to form a latent image on the photosensitive drum 107. Then, in order to visualize the latent image, the latent image is developed using the toner by the developing means 109.

The optical means 101 includes a laser diode 101*a*, a polygon mirror 101*b*, a lens 101*c* and a reflection mirror 101*d*.

The developing means 109 supplies the toner to the developing region of the photosensitive drum 107 to develop the latent image formed on the photosensitive drum 107. The developing means 109 feeds the toner within the toner frame 111 to the developing roller 109*c* through the toner supplying opening 111*i* by the rotation of a toner feeding member 109*b*.

Then, while the developing roller 109*c* including a stationary magnet therein is allowed to rotate, a toner layer in which a triboelectrification charge is induced by a developing blade 109*d* is formed on the surface of the developing roller 109*c*, and the toner is supplied to the developing region of the photosensitive drum 107.

Then, the toner image is formed and visualized by transporting the toner to the photosensitive drum 107 in accordance with the latent image. In this example, the developing blade 109*d* restricts the amount of toner on the peripheral surface of the developing roller 109*c* and induces the triboelectrification charge. Also, a toner agitating member 109*e* that circulates the toner within the developing chamber is rotatably fitted in the vicinity of the developing roller 109*c*.

Then, a voltage opposite in polarity to that of the toner image is applied to the transfer roller 104 disposed in the main body 114, and the toner image formed on the photosensitive drum 107 is transferred onto the recording medium 102. Thereafter, the residual toner on the photosensitive drum 107 is removed by the cleaning means 110.

The cleaning means 110 scrapes off the toner remaining on the photosensitive drum 107 by an elastic cleaning blade 110*a* provided in contact with the photosensitive drum 107 to collect the scraped toner into a waste toner reservoir 110*b*.

The process cartridge B is equipped with an exposure opening portion 101*e* for irradiating a beam corresponding to the image information onto the photosensitive drum 107 and a transfer opening portion 113*n* for making the photosensitive drum 107 face the recording medium 102.

In more detail, the exposure opening portion 101*e* is formed in the cleaning frame 113, and the transfer opening portion 113*n* is formed between the developing frame 112 and the cleaning frame 113.

In the toner frame 111 of the process cartridge B thus structured, the toner supplying opening 111*i* is subjected to the process in any one of the above-mentioned embodiments to seal the toner filled within the toner frame 111, before the process cartridge B is used.

That is, the toner frame 111 corresponds to the toner supply container main body 2 shown in FIG. 6 and the toner supplying opening 111*i* corresponds to the toner supplying opening 2*a*.

Accordingly, the detailed description of sealing is referred to any one of the above first to fifth embodiments.

As shown in FIG. 28, a sealing member 1 is disposed on the toner frame 111 so as to cover the toner supplying opening 111*i* to seal the toner within the toner frame 111.

Then, the leading end of the drawer portion 1*h* of the sealing member 1 is projected from the process cartridge B toward the outside. In use of the process cartridge B, the drawer portion 1*h* is first drawn to remove the sealing member 1 that seals the toner supplying opening 111*i*. Then, the process cartridge B from which the sealing member 1 is removed is mounted on the laser beam printer A, and the above development is conducted.

The mounting of the process cartridge B on the laser beam printer A will be described with reference to FIG. 27. In the laser beam printer A, when an open/close member 35 is opened by taking a hinge 35*a* as a center, a forward-down guide rail (not shown) is seen on each of the right and left inner walls of the main body 114.

A cylindrical guide (not shown) coaxially with the photosensitive drum 107 and a slender positioning guide (not shown) at the rear of the cylindrical guide are inserted into the above guide rail, and the cylindrical guide is fitted into the positioning groove of the main body 114.

Conversely, when the process cartridge B mounted on the main body 114 is removed, the process cartridge B is drawn along the guide rail in a procedure which is contrary to the above one.

If the process cartridge shown in this embodiment is welded by using the impulse seal the sealing member 1 as in the toner container of the first embodiment, it is capable of surely tearing and unsealing the sealing member 1, resulting in the lack of appearance of a guide failure or an inter-layer separation phenomenon, and the obtaining of a sufficient sealing property.

In addition, in this example, the sealing member is welded by using the respective sealing members and the structure of the electrode unit of the respective impulse seals of the second to fifth embodiments, to thereby obtain the same effects as those of the respective embodiments.

Note that in this example, in case of the structure of the fifth embodiment, there is a case in which the free end 8*a* of the sealing member 8 may run upon to the support seat of the developing roller, but the same effects as those of the fifth embodiment are obtained.

Note that, the process cartridge may be so structured as to be detachably mountable on the electrophotographic image forming apparatus and to include at least the developer containing chamber and the developing chamber. Also, the process cartridge may be so structured as include the electrophotographic photosensitive member in addition to the developer containing chamber and the developing chamber, or to include any one of the charging means and the cleaning means which is integrated with the electrophotographic photosensitive member.

In this example, the electrophotographic image forming apparatus is directed to a device for forming an image on a recording medium by using the electrophotographic process. The electrophotographic image forming apparatus is exemplified by an electrophotographic copying machine, an electrophotographic printer (for example, a laser beam printer, an LED printer), a facsimile machine, a word processor and so on.

COMPARATIVE EXAMPLE 1

This example is identical with the first embodiment except that the sealing member is welded and fixed onto the toner container main body by a heat seal. That is, the seal welding portion pattern shape is also identical with that in the first embodiment, and as shown in FIGS. 6 and 10, the outer sides of a leading edge portion 1*j*, which is the tear start portion is welded by the seal projection portion 3*b* through the heat sealing method.

However, in the case of the above structure, a float may rarely occur in the seal projection portion, and the extrusion of the sealant may be stuck onto the seal jig.

Also, when the number of molds for producing the container increases due to an increase in production volumes of the container main body 2 and a manufacture of a new mold for replacing an old mold, it becomes difficult to ensure the uniform sealing state, resulting in the possible weakening of the seal of the seal projection portion, and it takes much time to find out the appropriate sealing conditions.

As was described above, according to the respective embodiments, a sufficient sealing property and a stable unsealing property of the sealing member for sealing the toner discharge opening can be obtained.

Also, in the welding portion pattern shape of the electrode, the toner discharge opening sealing portion and the projection portion are divided, and a current is allowed to flow in different circuits from each other, thereby welding the sealing portion. As a result, because the sealing conditions of the projection portion can be freely controlled, the latitude of selection of the sealing conditions can be widened.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of manufacturing a developer container having an opening which is sealed with a sealing member, said method comprising the steps of:

forming a tear portion in said sealing member which is torn up when unsealing said opening;

sandwiching said sealing member between an electrode and said developer container to cover said opening with said sealing member; and welding said sealing member onto said developer container by supplying an electric current to said electrode.

2. A method according to claim 1, wherein a welding portion of said sealing member produced by said electrode includes a surrounding portion that surrounds said opening, and a reinforcing portion that reinforces a tear start portion of said sealing member.

3. A method according to claim 2, wherein said reinforcing portion is positioned outside of said tear portion in a direction substantially orthogonal to a tearing direction of said sealing member.

4. A method according to claim 3, wherein said reinforcing portion is apart from said surrounding portion.

5. A method according to claim 4, wherein said electrode includes a first electrode for forming said surrounding portion and a second electrode for forming said reinforcing portion.

6. A method according to claim 5, wherein said first electrode is insulated from said second electrode, and an electric current which is supplied to said first electrode and an electric current which is supplied to said second electrode are controlled, independently.

7. A method according to claim 6, wherein said reinforcing portion is welded onto said developer container by a welding force stronger than a welding force by which said surrounding portion is welded onto said developer container.

8. A method according to claim 2, wherein a welding step of welding said surrounding portion onto said developer container and a welding step of welding said reinforcing portion onto said developer container are separately performed.

9. A method according to claim 1, wherein after said sealing member is sandwiched between said electrode and said developer container, an electric current is supplied to said electrode.

10. A method according to claim 9, wherein after said tear portion is formed in said sealing member, said sealing member is sandwiched between said electrode and said developer container.

11. A method according to claim 1, wherein the electric current is supplied to said electrode simultaneously when said sealing member is sandwiched between said electrode and said developer container.

12. A method according to claim 1, wherein an impulse electric current is supplied to said electrode.

13. A method according to claim 1, wherein said tear portion is formed by irradiating said sealing member with a laser beam.

14. A method according to claim 1, wherein a welding portion of said sealing member by said electrode surrounds said opening.

15. A method according to claim 1, wherein after said sealing member is thermally melted by said electrode, a supply of the electric current to said electrode is stopped.

16. A method according to claim 15, wherein a state in which said sealing member is sandwiched between said electrode and said developer container is maintained until a predetermined period of time elapses after the supply of the electric current to said electrode is stopped.

17. A developer container, comprising:

a developer container main body that contains developer therein;

an opening for discharging the developer from said developer container main body; and a sealing member that seals said opening, wherein said sealing member includes a tear portion which is torn up when said opening is unsealed, and wherein said sealing member is welded onto said developer container main body by supplying an electric current to an electrode in a state where said sealing member is sandwiched between said electrode and said developer container main body to cover said opening with said sealing member.

18. A developer container according to claim 17, wherein a welding portion of said sealing member produced by said electrode includes a surrounding portion that surrounds said opening, and a reinforcing portion that reinforces a tear start portion of said sealing member.

19. A developer container according to claim 18, wherein said reinforcing portion is positioned outside of said tear portion in a direction substantially orthogonal to a tearing direction of said sealing member.

20. A developer container according to claim 19, wherein said reinforcing portion is apart from said surrounding portion.

21. A developer container according to claim 20, wherein said reinforcing portion is welded onto said developer container by a welding force stronger than a welding force by which said surrounding portion is welded onto said developer container.

22. A developer container according to claim 17, wherein said sealing member is welded onto said developer container main body by supplying an impulse electric current to said electrode.

23. A developer container according to claim 17, wherein said tear portion is formed by irradiating said sealing member with a laser beam.

24. A developer container according to claim 17, wherein a welding portion of said sealing member produced by said electrode surrounds said opening.

25. A developer container according to claim 17, wherein said sealing member includes a blocking layer that blocks a laser beam, a melting layer which is melted by the laser beam, and an adhesive layer which is welded onto said developer container in the stated order; and wherein said tear portion is formed by irradiating the sealing member with the laser beam from a side of said adhesive layer.

26. A developer container according to claim 25, wherein said blocking layer is made of aluminum foil, said melting layer is made of biaxial oriented polyester, and said adhesive layer is made of a copolymer consisting of polyethylene and ethylene vinyl acetate.

27. A developer container according to claim 26, wherein said blocking layer is 5 to 15 $\mu$m in thickness, said melting layer is 40 to 70 $\mu$m in thickness and said adhesive layer is 40 to 70 $\mu$m in thickness.

28. A developer container according to claim 17, wherein said sealing member includes a cover film that seals said opening, and a tear tape that is lined on said cover film, and wherein said cover film is torn up by pulling said tear tape to unseal said opening.

29. A method of manufacturing a process cartridge which is detachably mountable on an image forming apparatus main body, said process cartridge including a developer containing chamber that has an opening which is sealed with a sealing member and contains developer therein, and a developing chamber that develops a latent image on an image bearing member with the developer, said method comprising the steps of:

forming a tear portion in said sealing member which is torn up when unsealing said opening;

sandwiching said sealing member between an electrode and said developer containing chamber to cover said opening with said sealing member; and welding said sealing member onto said developer containing chamber by supplying an electric current to said electrode.

30. A method according to claim 29, wherein a welding portion of said sealing member produced by said electrode includes a surrounding portion that surrounds said opening, and a reinforcing portion that reinforces a tear start portion of said sealing member.

31. A method according to claim 30, wherein said reinforcing portion is positioned outside of said tear portion in a direction substantially orthogonal to a tearing direction of said sealing member.

32. A method according to claim 31, wherein said reinforcing portion is apart from said surrounding portion.

33. A method according to claim 32, wherein said electrode includes a first electrode for forming said surrounding portion and a second electrode for forming said reinforcing portion.

34. A method according to claim 33, wherein said first electrode is insulated from said second electrode, and an electric current which is supplied to said first electrode and an electric current which is supplied to said second electrode are controlled, independently.

35. A method according to claim 34, wherein said reinforcing portion is welded onto said developer containing chamber by a welding force stronger than a welding force by which said surrounding portion is welded onto said developer containing chamber.

36. A method according to claim 30, wherein a welding step of welding said surrounding portion onto said developer containing chamber and a welding step of welding said reinforcing portion onto said developer containing chamber are separately performed.

37. A method according to claim 29, wherein after said sealing member is sandwiched between said electrode and said developer containing chamber, the current is supplied to said electrode.

38. A method according to claim 37, wherein after said tear portion is formed in said sealing member, said sealing member is sandwiched between said electrode and said developer containing chamber.

39. A method according to claim 29, wherein the electric current is supplied to said electrode simultaneously when said sealing member is sandwiched between said electrode and said developer containing chamber.

40. A method according to claim 29, wherein an impulse electric current is supplied to said electrode.

41. A method according to claim 29, wherein said tear portion is formed by irradiating said sealing member with a laser beam.

42. A method according to claim 29, wherein a welding portion of said sealing member produced by said electrode surrounds said opening.

43. A method according to claim 29, wherein after said sealing member is thermally melted by said electrode, a supply of the electric current to said electrode is stopped.

44. A method according to claim 43, wherein a state in which said sealing member is sandwiched between said electrode and said developer containing chamber is maintained until a predetermined period of time elapses after the supply of the electric current to said electrode is stopped.

45. A process cartridge which is detachably mountable on an image forming apparatus main body, said process cartridge comprising:

a developing chamber that develops a latent image on an image bearing member with developer;

a developer containing chamber for containing the developer therein and having an opening through which the developer is supplied to said developing chamber; and a sealing member that seals said opening, wherein said sealing member has a tear portion which is torn up when unsealing said opening, and wherein said sealing member is welded onto said developer containing chamber by supplying an electric current to said electrode in a state where said sealing member is sandwiched between said electrode and said developer containing chamber to cover said opening with said sealing member.

46. A process cartridge according to claim 45, wherein a welding portion of said sealing member produced by said electrode includes a surrounding portion that surrounds said opening, and a reinforcing portion that reinforces a tear start portion of said sealing member.

47. A process cartridge according to claim 46, wherein said reinforcing portion is positioned outside of said tear portion in a direction substantially orthogonal to a tearing direction of said sealing member.

48. A process cartridge according to claim 47, wherein said reinforcing portion is apart from said surrounding portion.

49. A process cartridge according to claim 48, wherein said reinforcing portion is welded onto said developer containing chamber by a welding force stronger than a welding force by which said surrounding portion is welded onto said developer containing chamber.

50. A process cartridge according to claim 45, wherein said sealing member is welded onto said developer containing chamber by supplying an impulse electric current to said electrode.

51. A process cartridge according to claim 45, wherein said tear portion is formed by irradiating said sealing member with a laser beam.

52. A process cartridge according to claim 45, wherein a welding portion of said sealing member produced by said electrode surrounds said opening.

53. A process cartridge according to claim 45, wherein said sealing member includes a blocking layer that blocks a laser beam, a melting layer which is melted by the laser beam, and an adhesive layer which is welded onto said developer containing chamber in the stated order, and wherein said tear portion is formed by irradiating the sealing member with the laser beam from a side of said adhesive layer side.

54. A process cartridge according to claim 53, wherein said blocking layer is made of aluminum foil, said melting layer is made of biaxial oriented polyester, and said adhesive layer is made of a copolymer consisting of polyethylene and ethylene vinyl acetate.

55. A process cartridge according to claim 54, wherein said blocking layer is 5 to 15 $\mu$m in thickness, said melting layer is 40 to 70 $\mu$m in thickness and said adhesive layer is 40 to 70 $\mu$m in thickness.

56. A process cartridge according to claim 45, wherein said sealing member includes a cover film that seals said opening, and a tear tape that is lined on said cover film, wherein said cover film is torn up by pulling said tear tape to unseal said opening.

57. A process cartridge according to claim 45, wherein said process cartridge incorporates said image bearing member.

58. A method of manufacturing a developer container having an opening which is sealed with a sealing member, said method comprising the steps of:

sandwiching said sealing member between an electrode and said developer container to cover said opening with said sealing member; and welding said sealing member onto said developer container by supplying an electric current to said electrode, wherein a welding portion of said sealing member produced by said electrode includes a surrounding portion that surrounds said opening, and a reinforcing portion that reinforces said surrounding portion.

59. A method according to claim 58, wherein said reinforcing portion is apart from said surrounding portion and on a peeling start side of said sealing member.

60. A method according to claim 59, wherein said electrode includes a first electrode for forming said surrounding portion and a second electrode for forming said reinforcing portion.

61. A method according to claim 60, wherein said first electrode is insulated from said second electrode, and an electric current which is supplied to said first electrode and an electric current which is supplied to said second electrode are controlled, independently.

62. A method according to claim 61, wherein said reinforcing portion is welded onto said developer container by a welding force stronger than a welding force by which said surrounding portion is welded onto said developer container.

63. A method according to claim 58, wherein a welding step of welding said surrounding portion onto said developer container and a welding step of welding said reinforcing portion onto said developer container are separately performed.

64. A method according to claim 58, wherein after said sealing member is sandwiched between said electrode and said developer container, an electric current is supplied to said electrode.

65. A method according to claim 64, wherein after performing a forming step of forming in said sealing member a tear portion which is torn up when said opening is unsealed, said sealing member is sandwiched between said electrode and said developer container.

66. A method according to claim 58, wherein the electric current is supplied to said electrode simultaneously when said sealing member is sandwiched between said electrode and said developer container.

67. A method according to claim 58, wherein an impulse electric current is supplied to said electrode.

68. A method according to claim 58, wherein said tear portion is formed by irradiating said sealing member with the laser beam.

69. A method according to claim 58, wherein a welding portion of said sealing member produced by said electrode surrounds said opening.

70. A method according to claim 58, wherein after said sealing member is thermally melted by said electrode, a supply of the electric current to said electrode is stopped.

71. A method according to claim 70, wherein a state in which said sealing member is sandwiched between said electrode and said developer container is maintained until a predetermined period of time elapses after the supply of the electric current to said electrode stopped.

72. A developer container comprising:

a developer container main body that contains a developer therein;

an opening for discharging the developer from said developer container main body; and a sealing member that seals said opening, wherein said sealing member is welded onto said developer container main body by supplying an electric current to an electrode in a state where said sealing member is sandwiched between said electrode and said developer container main body to cover said opening with said sealing member, and wherein a welding portion of said sealing member produced by said electrode includes a surrounding portion that surrounds said opening, and a reinforcing portion that reinforces said surrounding portion.

73. A developer container according to claim 72, wherein said reinforcing portion is apart from said surrounding portion and on a peeling start side of said sealing member.

74. A developer container according to claim 73, wherein said electrode includes a first electrode for forming said surrounding portion and a second electrode for forming said reinforcing portion.

75. A developer container according to claim 74, wherein said first electrode is insulated from said second electrode, and an electric current which is supplied to said first electrode and an electric current which is supplied to said second electrode are controlled, independently.

76. A developer container according to claim 75, wherein said reinforcing portion is welded onto said developer container by a welding force stronger than a welding force by which said surrounding portion is welded onto said developer container.

77. A developer container according to claim 72, wherein after said sealing member is sandwiched between said electrode and said developer container, the electric current is supplied to said electrode.

78. A developer container according to claim 77, wherein said sealing member has a tear portion which is torn up when said opening is unsealed, and wherein after said tear portion is formed in said sealing member, said sealing member is sandwiched between said electrode and said developer container.

79. A developer container according to claim 72, wherein an electric current is supplied to said electrode simultaneously when said sealing member is sandwiched between said electrode and said developer container.

80. A developer container according to claim 72, wherein an impulse electric current is supplied to said electrode.

81. A developer container according to claim 72, wherein said sealing member has a tear portion which is torn up when said opening is unsealed, and wherein said tear portion is formed by irradiating said sealing member with a laser beam.

82. A developer container according to claim 72, wherein a welding portion of said sealing member by said electrode surrounds said opening.

83. A developer container according to claim 72, wherein after said sealing member is thermally melted by said electrode, a supply of the electric current to said electrode is stopped.

84. A developer container according to claim 83, wherein a state in which said sealing member is sandwiched between said electrode and said developer container is maintained until a predetermined period of time elapses after the supply of the electric current to said electrode is stopped.

85. A developer container according to claim 72, wherein said sealing member has a tear portion which is torn up when said opening is unsealed, and wherein said sealing member includes a blocking layer that blocks a laser beam, a melting layer which is melted by the laser beam, and an adhesive layer which is welded onto said developer container in the stated order, and wherein said tear portion is formed by irradiating said sealing member with the laser beam from a side of said adhesive layer.

86. A developer container according to claim 85, wherein said blocking layer is made of aluminum foil, said melting layer is made of biaxial oriented polyester, and said adhesive layer is made of a copolymer consisting of polyethylene and ethylene vinyl acetate.

87. A developer container according to claim 86, wherein said blocking layer is 5 to 15 $\mu$m in thickness, said melting layer is 40 to 70 $\mu$m in thickness and said adhesive layer is 40 to 70 $\mu$m in thickness.

88. A developer container according to claim 72, wherein said sealing member includes a cover film that seals said opening, and a tear tape that is lined on said cover film, and wherein said cover film is torn up by pulling said tear tape to unseal said opening.

89. A method of manufacturing a process cartridge which is detachably mountable on an image forming apparatus main body, said process cartridge including a developer containing chamber that has an opening which is sealed with a sealing member and contains developer therein, and a developing chamber that develops a latent image on an image bearing member with the developer, said method comprising the steps of:

sandwiching said sealing member between an electrode and said developer containing chamber to cover said opening with said sealing member; and welding said sealing member onto said developer containing chamber by supplying an electric current to said electrode, wherein a welding portion of said sealing member produced by said electrode includes a surrounding portion that surrounds said opening, and a reinforcing portion that reinforces said surrounding portion.

90. A method according to claim 89, wherein said reinforcing portion is apart from said surrounding portion and on a peeling start side of said sealing member.

91. A method according to claim 90, wherein said electrode includes a first electrode for forming said surrounding portion and a second electrode for forming said reinforcing portion.

92. A method according to claim 91, wherein said first electrode is insulated from said second electrode, and an electric current which is supplied to said first electrode and an electric current which is supplied to said second electrode are controlled, independently.

93. A method according to claim 92, wherein said reinforcing portion is welded onto said developer containing chamber by a welding force stronger than a welding force by which said surrounding portion is welded onto said developer containing chamber.

94. A method according to claim 89, wherein a welding step of welding said surrounding portion onto said developer containing chamber and a welding step of welding said reinforcing portion onto said developer containing chamber are separately performed.

95. A method according to claim 89, wherein after said sealing member is sandwiched between said electrode and said developer containing chamber, the electric current is supplied to said electrode.

96. A method according to claim 95, wherein said sealing member has a tear portion which is torn up when said opening is unsealed, and wherein after said tear portion is formed in said sealing member, said sealing member is sandwiched between said electrode and said developer containing chamber.

97. A method according to claim 89, wherein the electric current is supplied to said electrode simultaneously when said sealing member is sandwiched between said electrode and said developer containing chamber.

98. A method according to claim 89, wherein an impulse electric current is supplied to said electrode.

99. A method according to claim 89, wherein said sealing member has a tear portion which is torn up when said opening is unsealed, and wherein said tear portion is formed by irradiating said sealing member with a laser beam.

100. A method according to claim 89, wherein a welding portion of said sealing member produced by said electrode surrounds said opening.

101. A method according to claim 89, wherein after said sealing member is thermally melted by said electrode, a supply of the electric current to said electrode is stopped.

102. A method according to claim 101, wherein a state in which said sealing member is sandwiched between said electrode and said developer containing chamber is maintained until a predetermined period of time elapses after the supply of the electric current to said electrode is stopped.

103. A process cartridge which is detachably mountable on an image forming apparatus main body, said process cartridge comprising:

a developing chamber that develops a latent image on an image bearing member with developer;

a developer containing chamber for containing the developer therein and having an opening through which the developer is supplied to said developing chamber; and a sealing member that seals said opening, wherein said sealing member is welded onto said developer containing chamber by supplying an electric current to an electrode in a state in which said sealing member is sandwiched between said electrode and said developer containing chamber to cover said opening with said sealing member, and wherein a welding portion of said sealing member produced by said electrode includes a surrounding portion that surrounds said opening, and a reinforcing portion that reinforces said surrounding portion.

104. A process cartridge according to claim 103, wherein said reinforcing portion is apart from said surrounding portion and on a peeling start side of said sealing member.

105. A process cartridge according to claim 104, wherein said electrode includes a first electrode for forming said surrounding portion and a second electrode for forming said reinforcing portion.

106. A process cartridge according to claim 105, wherein said first electrode is insulated from said second electrode, and an electric current which is supplied to said first electrode and an electric current which is supplied to said second electrode are controlled, independently.

107. A process cartridge according to claim 106, wherein said reinforcing portion is welded onto said developer containing chamber by a welding force stronger than a welding force by which said surrounding portion is welded onto said developer containing chamber.

108. A process cartridge according to claim 103, wherein after said sealing member is sandwiched between said electrode and said developer containing chamber, the electric current is supplied to said electrode.

109. A process cartridge according to claim 108, wherein said sealing member has a tear portion which is torn up when said opening is unsealed, and wherein after said tear portion is formed in said sealing member, said sealing member is sandwiched between said electrode and said developer containing chamber.

110. A process cartridge according to claim 103, wherein an electric current is supplied to said electrode simultaneously when said scaling member is sandwiched between said electrode and said developer containing chamber.

111. A process cartridge according to claim 103, wherein an impulse electric current is supplied to said electrode.

112. A process cartridge according to claim 103, wherein said sealing member has a tear portion which is torn up when said opening is unsealed, and wherein said tear portion is formed by irradiating said sealing member with a laser beam.

113. A process cartridge according to claim 103, wherein a welding portion of said sealing member produced by said electrode surrounds said opening.

114. A process cartridge according to claim 103, wherein after said sealing member is thermally melted by said electrode, a supply of the electric current to said electrode is stopped.

115. A process cartridge according to claim 114, wherein a state in which said sealing member is sandwiched between said electrode and said developer containing chamber is maintained until a predetermined period of time elapses after the supply of the electric current to said electrode is stopped.

116. A process cartridge according to claim 103, wherein said process cartridge incorporated said image bearing member is therein.

* * * * *

UNITED STATES PATENT AND TRADEMARK OFFICE

CERTIFICATE OF CORRECTION

PATENT NO. : 6,501,924 B2
DATED : December 31, 2002
INVENTOR(S) : Toshiaki Nagashima It is certified that error appears in the above-identified patent and that said Letters Patent is hereby corrected as shown below:

Column 2,
Line 2, “pat” should read -- part --.

Column 5,
Line 60, “cross sectional” should read -- cross-sectional --.

Column 8,
Line 66, “fplded” should read -- folded --.

Column 11,
Line 9, “for” should be deleted.
Line 47, “3*h*” should read -- 3*b* --.

Column 12,
Line 45, “in” should read -- in the --.

Column 15,
Line 26, (close up left margin).
Line 27, (close up right margin).

Column 17,
Line 46, “as” should read -- as to --.
Line 50, “means” should read -- means, --.

Column 20,
Line 18, “order; and” should read -- order, and --.

Signed and Sealed this

Fifteenth Day of June, 2004

JON W. DUDAS
*Acting Director of the United States Patent and Trademark Office*